United States Patent [19]

Satterwhite

[11] 4,162,584

[45] Jul. 31, 1979

[54] EXCAVATING WHEEL WITH CAM ASSISTED BUCKET WALL EJECTOR

[75] Inventor: Charles L. Satterwhite, Dallas, Tex.

[73] Assignee: Unit Rig & Equipment Co., Tulsa, Okla.

[21] Appl. No.: 904,383

[22] Filed: May 10, 1978

Related U.S. Application Data

[60] Division of Ser. No. 745,860, Nov. 29, 1976, which is a division of Ser. No. 660,515, Feb. 23, 1976, Pat. No. 4,062,562, which is a continuation of Ser. No. 554,671, Mar. 3, 1975, abandoned, which is a continuation-in-part of Ser. No. 400,043, Sep. 24, 1973, Pat. No. 3,897,109, which is a continuation-in-part of Ser. No. 238,089, Mar. 28, 1972, abandoned.

[51] Int. Cl.[2] ..... E02F 3/18

[52] U.S. Cl. ..... 37/190; 37/DIG. 2

[58] Field of Search ..... 37/189, 190, 94–97, 37/91, DIG. 2, DIG. 16, 86–87; 299/73–75

[56] References Cited

U.S. PATENT DOCUMENTS

| | | | |
|---|---|---|---|
| 857,396 | 6/1907 | Hammond | 37/DIG. 2 |
| 1,336,657 | 4/1920 | Schmidt | 37/189 |
| 1,434,601 | 11/1922 | French | 37/DIG. 2 |
| 1,455,206 | 5/1923 | Howe et al. | 37/97 |
| 1,516,428 | 11/1924 | Handley | 37/189 X |
| 1,858,327 | 5/1932 | Hays | 37/190 |
| 2,528,012 | 10/1950 | Mensforth | 37/190 X |
| 2,748,505 | 6/1956 | Turner | 37/96 |
| 3,230,647 | 1/1966 | Gates | 37/190 |
| 3,390,473 | 7/1968 | Wilms et al. | 37/190 |
| 3,500,563 | 3/1970 | Smith | 37/190 |

FOREIGN PATENT DOCUMENTS

| | | | |
|---|---|---|---|
| 992676 | 5/1965 | United Kingdom | 37/190 |
| 137833 | 10/1956 | U.S.S.R. | 37/190 |

*Primary Examiner*—Eickholt E. H.

*Attorney, Agent, or Firm*—Richards, Harris & Medlock

[57] ABSTRACT

An excavating and loading system is disclosed which includes a vehicle with an excavating wheel assembly at the front. This wheel assembly includes plural excavating wheels each comprising a plurality of digging buckets having a wall supported for pivotal movement between a material receiving position and a material dumping position. A spring is connected to each movable wall for normally positioning the wall in the material receiving position. A cam mounted on each movable wall is engaged by a mechanism fixedly supported at a point offset from the rotational axis of the excavating wheel to pivot each movable wall to the material dumping position against the action of the spring associated therewith.

1 Claim, 35 Drawing Figures

EXCAVATING WHEEL WITH CAM ASSISTED BUCKET WALL EJECTOR

BACKGROUND AND SUMMARY OF THE INVENTION

This application is a divisional of application Ser. No. 745,860, filed Nov. 29, 1976; which in turn is a divisional of application Ser. No. 660,515, filed Feb. 23, 1976, now U.S. Pat. No. 4,062,562; which in turn was a continuation of application Ser. No. 554,671, filed Mar. 3, 1975, now abandoned; which in turn was a continuation-in-part of application Ser. No. 400,043, filed Sept. 24, 1973, now U.S. Pat. No. 3,897,109; which in turn was a continuation-in-part of application Ser. No. 238,089, filed Mar. 28, 1972, and now abandoned.

The present invention relates to improvements in moldboards and conveyor folding and operation which are particularly applicable to excavating and loading systems of the type disclosed and claimed in the above-identified co-pending application.

According to one aspect of the invention, an auxiliary conveyor is mounted behind a main conveyor. The discharge end of the auxiliary conveyor is mounted for pivotal movement generally outwardly and downwardly. This movement raises the material receiving end of the auxiliary conveyor. The upper and rearward portion of the main conveyor is then pivoted downwardly into the space provided by the upward movement of the material receiving end of the auxiliary conveyor. The auxiliary conveyor is then rotated over the discharge end of the main conveyor. This substantially reduces the overall height of the excavating and loading system for travel and storage purposes.

In accordance with another aspect of the invention, a third conveyor can be mounted at the discharge end of the auxiliary conveyor. This third conveyor is mounted to pivot up under the auxiliary conveyor to reduce the overall length and height of the excavating and loading system for travel purposes.

In accordance with another aspect of the invention, a moldboard is mounted generally behind and beneath the excavating wheel assembly. The moldboard assembly has a scraper blade and a bearing plate. The moldboard is pivotally supported, and a linkage connects the moldboard to an apparatus which controls the vertical position of the excavating wheel assembly. The blade of the moldboard functions to remove ridges that might otherwise remain between the wheels of the excavating wheel assembly, and to clean the excavation. The bearing plate of the moldboard is utilized in the operation of the excavating and loading system to partially support and to stabilize the excavating wheel assembly. The angular positioning of the bearing plate also varies as the moldboard is raised and lowered to facilitate initiation and termination of the excavation.

In accordance with a further aspect of the present invention, the auxiliary conveyor assembly has two in-line conveyors. The innermost conveyor is arranged to selectively discharge material onto the outer conveyor or into a vehicle. The outer conveyor is adjustable in attitude with respect to the inner conveyor to control the discharge height of the outer conveyor. Variably positionable deflector plates are mounted at the discharge ends of the inner and outer conveyors to direct the discharged material.

DESCRIPTION OF THE DRAWINGS

A more complete understanding of the invention may be had by referring to the following Detailed Description when taken in conjunction with the accompanying Drawings, in which.

DETAILED DESCRIPTION

Figure 1:
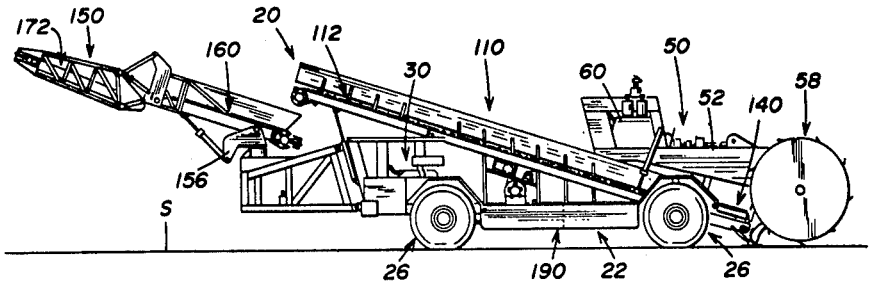
FIG. 1 is a side elevation of an excavating and loading system comprising a first embodiment of the invention.

Referring now to the Drawings, and particularly to FIGS. 1 through 6, a first embodiment of an excavating and loading system 20 incorporating the invention is shown. The system 20 comprises an apparatus which can be used to excavate and load materials on vehicles for transportation. The system is of the type which travels along constantly excavating materials and lifts and loads the materials on a conveyor system. The material is then transported to and discharged in a vehicle such as a dump truck or the like. The system is especially adapted for use in excavating in open areas, in forming trenches, and the like, and also in confined areas, such as mines where vertical clearance is limited. As will be particularly described and pointed out hereinafter the embodiments of the invention incorporate improvements in the moldboards and conveyor configuration and operation.

The system 20 comprises a vehicle 22 including a main frame 24 which is supported by four wheels 26 for movement along a surface S. Each of the wheels 26 comprises a pneumatic tire 28 whereby the excavating and loading system 20 is adapted for movement over highways and other paved surfaces as well as for operation in unpaved areas, such as during an excavating operation.

A first engine 30 is supported on the main frame 24 of the vehicle 22. In accordance with the preferred embodiment of the invention, the first engine 30 is an internal combustion engine and functions to drive a plurality of hydraulic pumps 32. The pumps 32 in turn supply operating power for various components of the excavating and loading system 20. For example, one of the pumps 32 supplies operating power for a hydrostatic drive 34. The hydrostatic drive 34 is coupled to a transmission 36 including a brake 38. The transmission 36 provides dual outputs which are coupled to a forward differential 40 and a rear differential 42 by a plurality of drive shafts 44. Thus, the hydrostatic drive 34 operates by means of the wheels 26 to propel the excavating and loading system 20 both during excavating operations and during travel.

An excavating system 50 comprises the forward portion of the excavating and loading system 20. The excavating system 50 includes a subframe 52 which is supported on a shaft 54 for pivotal movement relative to the vehicle 22 under the action of a pair of hydraulic cylinders 56 supplied by one of the pumps 32 which are driven by the first engine 30.

The excavating system 50 further includes an excavating wheel assembly 58 which is supported at the front end of the subframe 52. The excavating wheel assembly 58 is driven by a second internal combustion engine 60 which is supported at the rear end of the subframe 52. The engine 60 provides operating power for the excavating wheel assembly 58 but otherwise plays no part in the operation of the excavating and loading system 20. This arrangement has been found to be highly satisfactory for two reasons. First, it permits selection of the second engine 60 on the basis of the power requirements of the excavating system 50 only and not on the basis of the power requirements of the other components of the excavating and loading system 20. Also, due to its positioning at the rear of the subframe 52, the second engine 60 acts as a counterbalance for the weight of the excavating wheel assembly 58. This permits the use of hydraulic cylinders 56 of reduced size and also reduces the amount of power that is required in manipulating the excavating wheel assembly 58.

Figure 6:
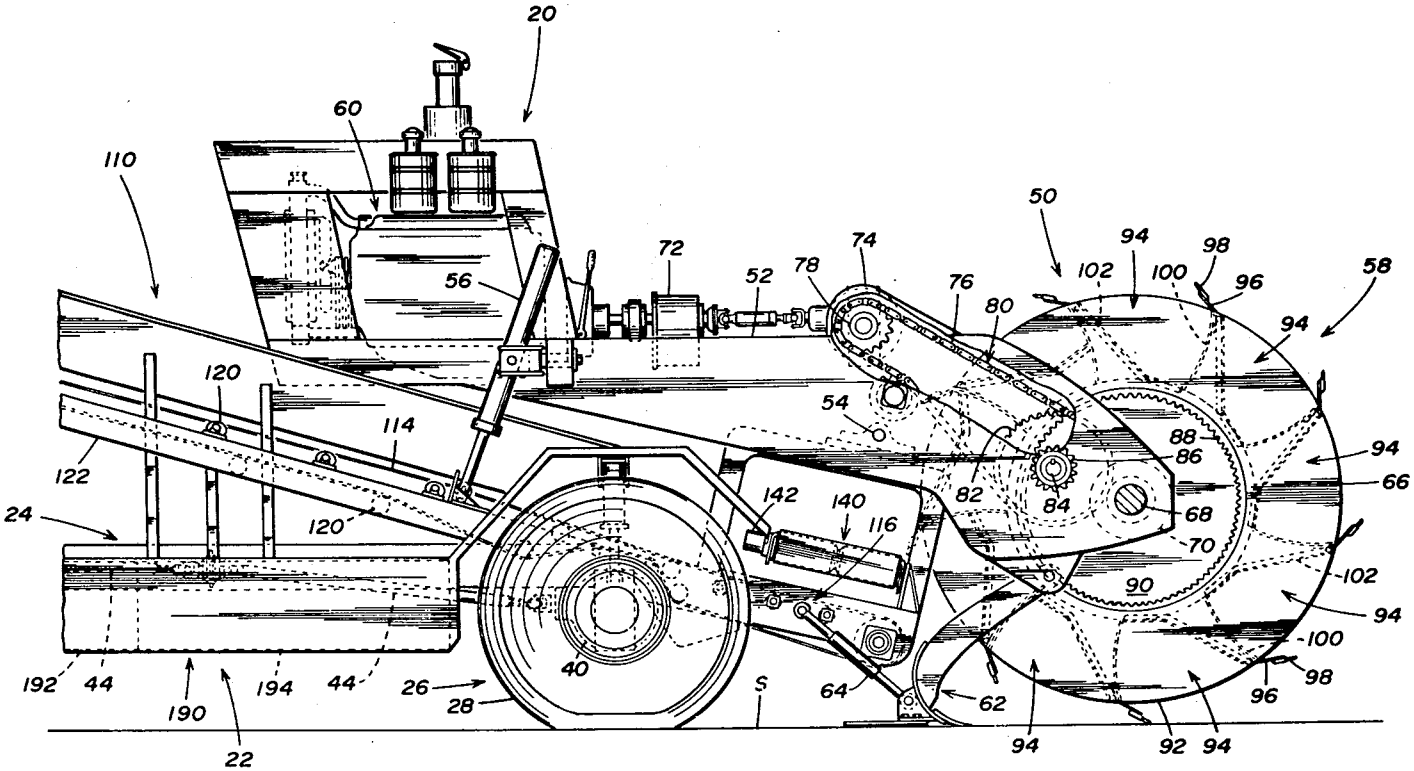
FIG. 6 is an enlarged view of the forward portion of the excavating and loading system illustrated in FIG. 1, showing a first embodiment of the improved moldboard of the present invention.

As is shown in FIG. 6, one embodiment of a moldboard 62 of the present invention is supported at the front end of the vehicle 22 of the excavating and loading system 20 beneath the excavating wheel assembly 58. The moldboard 62 is connected to the vehicle 22 by a pair of turnbuckels 64 and is also connected to the subframe 52.

Figure 2:
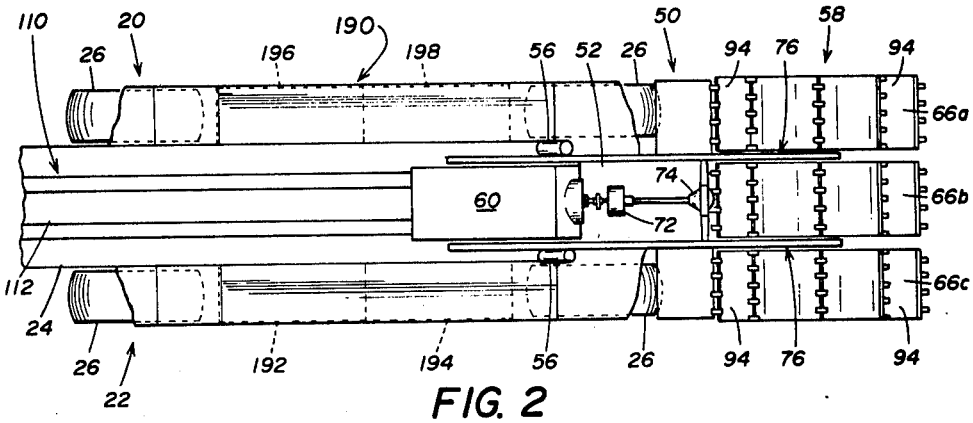
FIG. 2 is a partial plan view of the excavating and loading system illustrated in FIG. 1.
Figure 3:
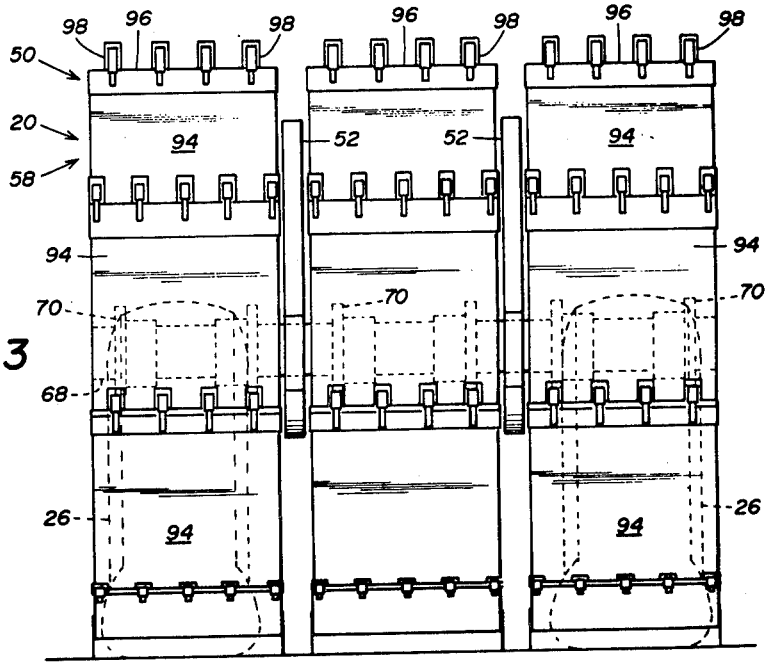
FIG. 3 is a partial front elevation of the excavating and loading system illustrated in FIG. 1.

In FIGS. 2, 3, and 6, the excavating wheel assembly 58 is shown. Assembly 58 comprises three excavating wheels 66A, 66B and 66C, which are rotatably supported on the subframe 52 by a shaft 68 and a plurality of bushings 70. The second engine 60 drives a speed reducer 72 which in turn drives a right angle drive 74. The right angle drive 74 actuates a pair of chain and sprocket drives 76 each including a sprocket 78 driven by the right angle drive 74, a chain 80 driven by the sprocket 78, and a sprocket 82 driven by the chain 80. As is best shown in FIG. 2, the chains 80 and the sprockets 82 are mounted within the subframe 52 and are therefore protected from damage due to accumulations of dirt, etc. during the operation of the excavating and loading system 20.

Each sprocket 82 is mounted on a shaft 84 which is rotatably supported in the subframe 52 and which in turn supports a pair of pinions 86. The pinions 86 are each mounted in mesh with a ring gear 88 mounted on one of the wheels 66 whereby the second engine 60 functions to rotate the wheels. In accordance with the preferred embodiment of the invention, the center excavating wheel 66B is provided with two ring gears 88 and is driven by two pinions 86, whereas the side excavating wheels 66A and 66C support a single ring gear 88 and are driven by a single pinion 86. In this manner the center wheel functions to maintain relative timing between the wheels 66A, 66B and 66C and to maintain equal loading on both sides of the excavating wheel drive system.

The excavating wheels 66 of the excavating wheel assembly 58 each includes a hub 90 and a pair of rims 92 which extend radially outwardly from the hub. The excavating wheels comprise a plurality of digging buckets 94 which are equally spaced circumferentially around the hub 90 and which extend between the rims 92. The digging buckets 94 each have a cutting edge 96 including a plurality of teeth 98 and a stationary front wall 100 extending generally radially inwardly from the cutting edge 96. Each digging bucket further includes a rear wall 102 which is supported for pivotal movement between a digging position and a dumping position. The rear walls 102 of the digging buckets 94 are actuated by one of the mechanisms shown in FIGS. 7 through 12 and are manipulated thereby to the digging position when their respective digging buckets 94 are in the lower and forward portion of their rotary motion and to the dumping position when their respective digging buckets are in the upper and rearward portion of their rotary motion.

As is clearly shown in FIGS. 2 and 3, the three wheels 66A, 66B and 66C comprising the excavating wheel assembly 58 have an overall width which exceeds that of the remaining components of the excavating and loading system 20. This has been found to be highly advantageous for two reasons. First, by increasing the width of the excavating wheel assembly 58 over that of a conventional ditching machine, an excavating and loading system incorporating the present invention is capable of excavating considerably more material without increasing the speed of rotation of the excavating wheel assembly. Second, the fact that the excavating wheel assembly 58 is wider than the remaining components of the excavating and loading system 20 permits operation of the excavating and loading system within the excavation that is being formed. This materially reduces the amount of movement of the excavating wheel assembly 58 that is necessary to position the assembly for excavating and for travel, and thereby reduces the overall complexity of an excavating and loading system incorporating the invention.

The excavating and loading system 20 further includes a loading system 110. The loading system 110 includes a main conveyor 112 comprising an endless belt 114 mounted for movement around a course extending angularly upwardly relative to the main frame 24 of the vehicle 22 and including a material receiving portion 116 and a material discharge or delivery portion 118. More particularly, the course of the belt 114 is defined by a plurality of rollers 120 which are supported on a conveyor frame 122. The conveyor frame 122 is supported on the main frame 24 of the vehicle 22 and includes an upper portion 124 supported for pivotal movement about a horizontal axis under the action of a hydraulic cylinder 126. This permits control over the vertical positioning of the material discharge portion 118 of the conveyor 112.

The belt 114 of the main conveyor 112 extends around a relatively small drum 128 mounted at the upper end of the frame 122 and around a relatively large drum 130 mounted on the frame 24. The drums 128 and 130 are rotated by radial hydraulic motors 132 and 134, respectively. By this means the belt 114 is actuated for movement around the course defined by the rollers 120 to move material from the material receiving portion 116 to the material discharge portion 118. It has been found that the positioning of the drums 128 and 130 causes a synergistic effect in that the drum 130 functions to cause the belt 114 to wrap more tightly around the drum 128 and thereby increase the effectiveness of the motor 132 in moving the belt 114.

A pair of cross conveyors 140 are also supported on the main frame 24 of the vehicle 22. The cross conveyors 140 are driven by hydraulic motors 142 and function to receive material from the side excavating wheels 66A and 66C and to deliver the material to the material receiving portion 116 of the main conveyor 112. By this means all material that is excavated by the excavating wheel assembly 58 is delivered to the main conveyor 112 for transportation thereby from the material receiving portion 116 to the material discharge portion 118.

Figure 4:
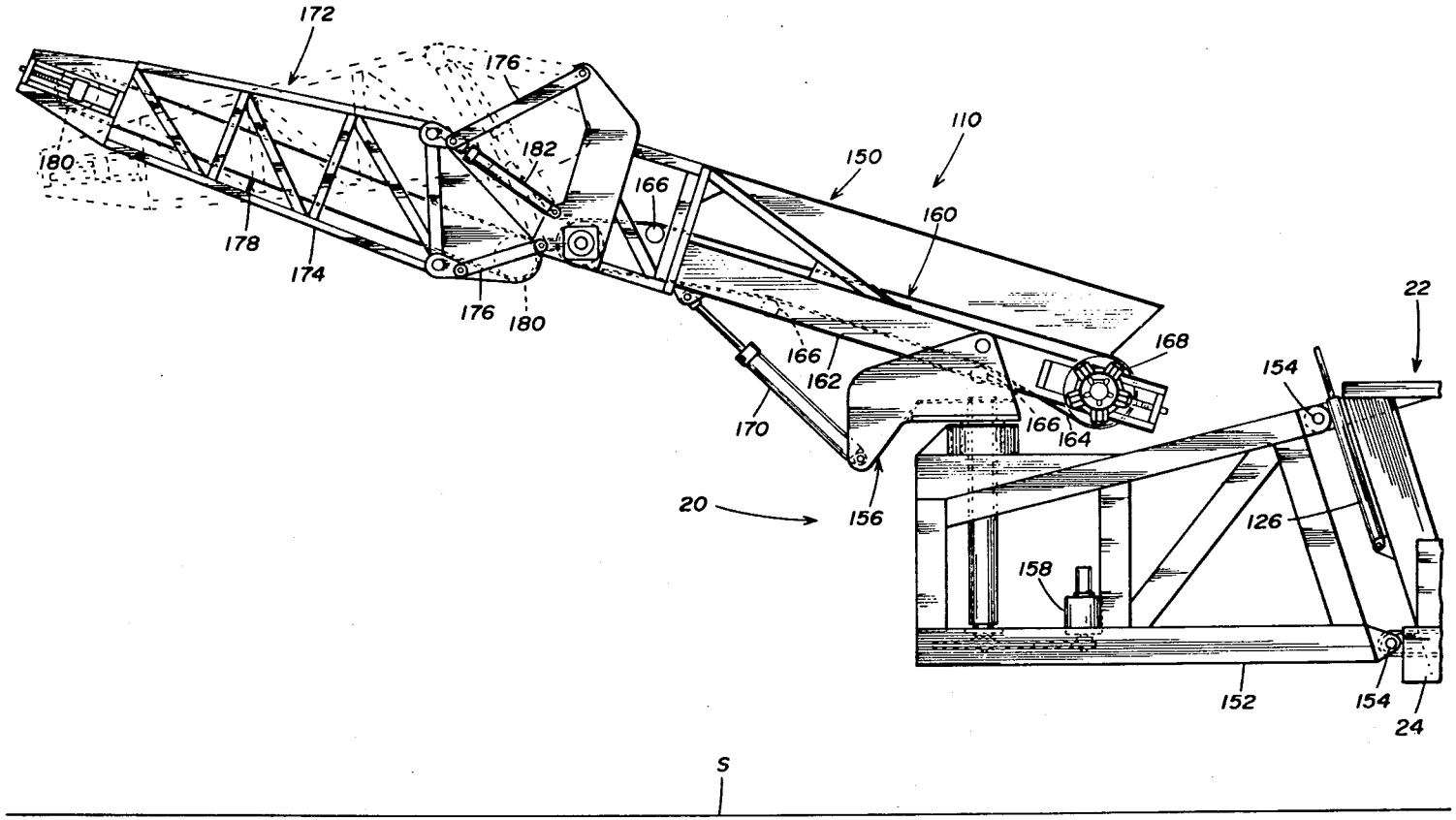
FIGS. 4 and 5 are enlarged views, respectively, of the rear and central portions of the excavating and loading system illustrated in FIG. 1.

Referring now particularly to FIGS. 1 and 4, this embodiment of the invention further includes a first embodiment of an auxiliary conveyor system 150. The auxiliary conveyor system 150 includes a frame 152 which is secured to the rear end of the frame 24 of the vehicle 22 by a plurality of pins 154. A turntable 156 is supported on the frame 152 for pivotal movement about a vertical axis under the action of a hydraulic motor 158.

An inner conveyor 160 is supported on the turntable 156 to receive material discharged from the material discharge portion 118 of the main conveyor 112. The conveyor 160 comprises a frame 162 which is supported on the turntable 156 and an endless belt 164 mounted for movement around a course defined by a plurality of rollers 166. The belt 164 is driven by a radial hydraulic motor 168, and a hydraulic cylinder 170 is provided for controlling the angular relationship of the frame 162 to the turntable 156.

The auxiliary conveyor system 150 further includes an outer conveyor 172 comprising a frame 174 which is supported on the frame 162 of the conveyor 160 by a pair of parallel links 176. An endless belt 178 is supported on the frame 174 for movement around a course defined by a pair of drums 180. The belt 178 is driven by small hydraulic motors (not shown) mounted in the drums 180.

A hydraulic cylinder 182 extends between the frame 162 of the conveyor 160 and the frame 174 of the conveyor 172 for actuation to manipulate the conveyor 172 between the positions shown in full and in dashed lines in FIG. 4. When the conveyor 172 is positioned as shown in full lines in FIG. 4, it functions to receive material from the conveyor 160 and to discharge the material from the end of the excavating and loading system 20 remote from the excavating system 50. On the other hand, when the conveyor 172 is positioned as shown in dashed lines in FIG. 4, material is discharged directly from the conveyor 160. As will be described in detail, this arrangement is highly advantageous in that it permits the positioning of a dump truck or similar vehicle under the discharge end of the conveyor 160 while another vehicle is being loaded from the conveyor 172, and vice versa.

It will be appreciated that the hydraulic motor 158 may be actuated to pivot the turntable 156 and the conveyors 160 and 172 supported thereon through an arc of approximately 180°. The excavating and loading system 20 may also be operated with the auxiliary conveyor system 150 removed, if desired. These conditions cause substantial changes in the overall weight distribution of the component parts of the excavating and loading system 20.

Figure 5:
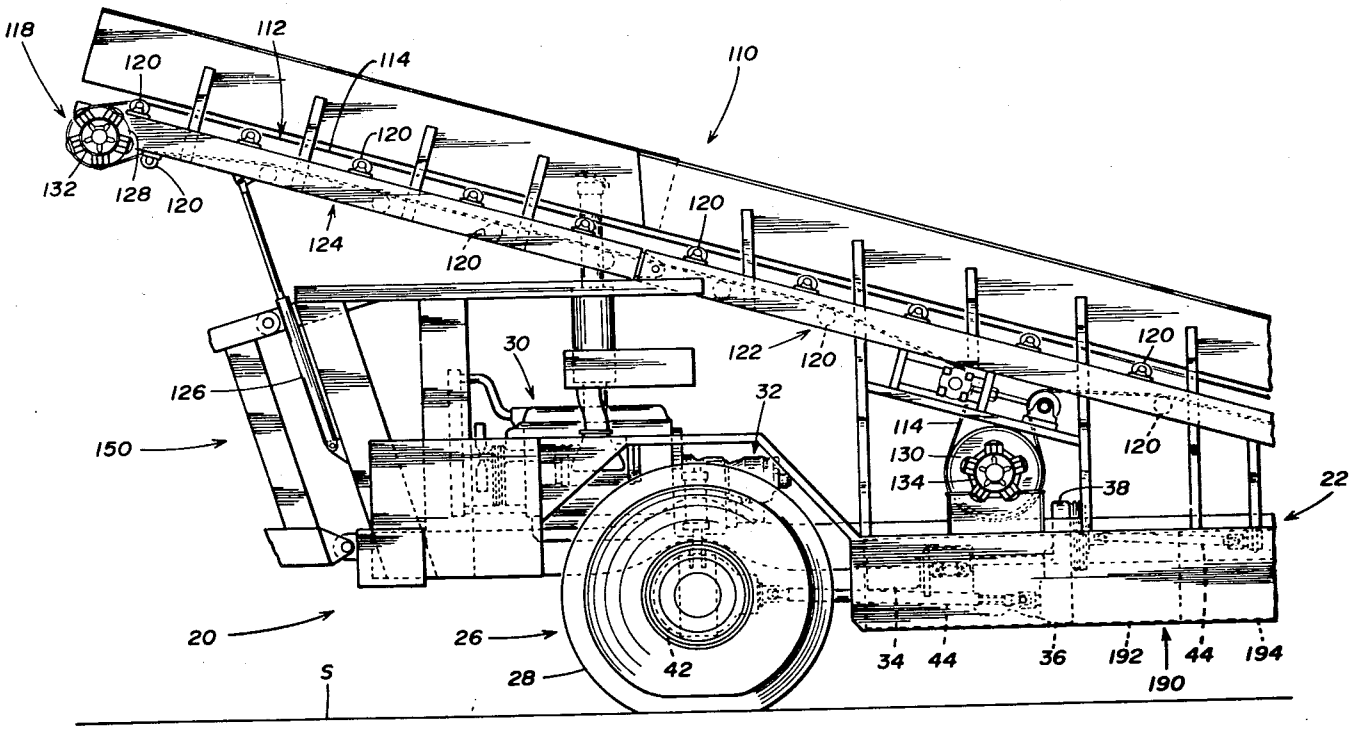

As is best shown in FIGS. 1, 2 and 5, the vehicle 22 is equipped with a counterbalancing system 190 comprising four ballast tanks 192, 194, 196 and 198 located at forward and rearward positions on opposite sides of the vehicle 22. In the use of the excavating and loading system 20, water is selectively pumped to and from the tanks comprising the counterbalancing system 190 whereby changes of the weight distribution of the excavating and loading system 20 caused by manipulations of the auxiliary conveyor system 150 are compensated for. Thus, if the excavating and loading system 20 is operated with the auxiliary conveyor system 150 removed, water is pumped out of the tanks 194 and 198 and into the tanks 192 and 196. Similarly, if the hydraulic motor 158 is operated to pivot the auxiliary conveyor system 150 towards one side of the vehicle 22, the tanks on the opposite side of the vehicle are filled with water whereby the change in weight distribution caused by the manipulation of the auxiliary conveyor system 150 is completely counterbalanced.

All of the hydraulic motors and all of the hydraulic cylinders comprising the loading system 110 are operatively connected to the pumps 32 which are driven by the first engine 30. Thus, the excavating and loading system 20 comprises separate excavating and loading systems 50 and 110, respectively, which are driven by independent power sources. This arrangement has been found to be advantageous in that it permits optimum utilization of both systems. For example, in certain instances it may be necessary to provide maximum operating power to the excavating system 50 and to simultaneously provide maximum operating power to the loading system 110. Such a situation is accommodated much more readily by means of the present invention than would otherwise be possible.

Various systems for actuating the rear walls 102 of the digging buckets 94 of the excavating wheels 66A, 66B and 66C are shown in FIGS. 7 through 12. In each instance the rear wall actuating system is located entirely within the margins of the excavating wheels. This may be compared with certain prior art systems characterized by external bucket wall actuating apparatus.

Figure 7:
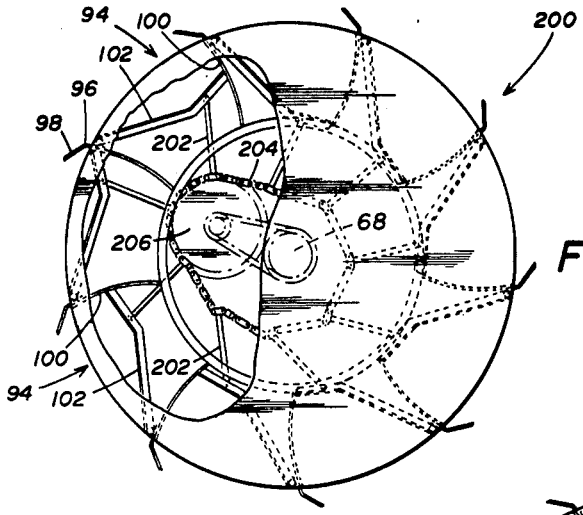
FIGS. 7 through 12 are illustrations of various systems for actuating the rear plates of the digging buckets of an excavating and loading system incorporating the invention.

Referring particularly to FIG. 7, an actuating system 200 comprises a plurality of push rods 202 each of which is connected between one of the rear walls 102 and a chain 204. The chain 204 is generally unconstrained but extends around a sprocket 206 which is supported on the shaft 68 and which is secured against angular movement relative to the shaft 68 by suitable brackets (not shown). As the digging wheels are rotated about the shaft 68 under the action of the second engine 60, each push rod 202 comes into engagement with the sprocket 206 whereupon its respective rear wall 102 is pushed outwardly to the material dumping position. Subsequently, as each digging bucket is rotated to the lower and forward portion of its circular path, the chain operates through the push rod 202 to positively return the rear wall 102 to the material digging position. This positive actuation of the rear wall 102 in both directions has been found to be vastly superior to the arrangement that has been used heretofore wherein the rear portions were allowed to return to the digging position under the action of gravity. Two factors involved in this superior performance are the positive discharge of sticky materials such as clays and the positive shedding of such sticky material from the movable bucket walls.

Figure 8:
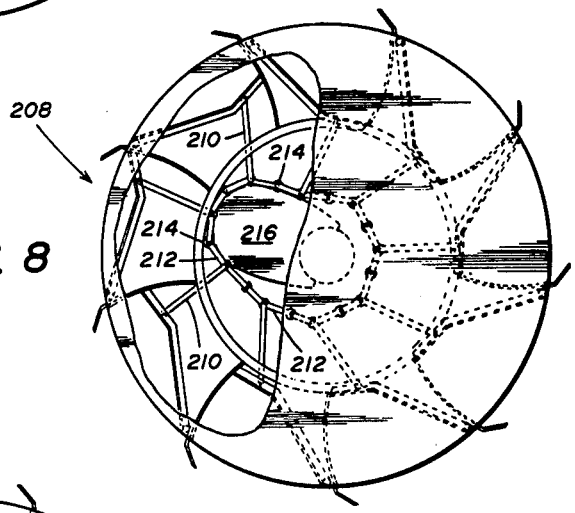

An actuating system 208 that is similar in many respects to the system 200 is shown in FIG. 8. The system 208 incorporates a plurality of push rods 210 each connected between a chain 212 and the rear wall 102 of one of the digging buckets 94. The principal difference between the system 208 and the system 200 is that the chain 212 of the system 208 is equipped with a plurality of rollers 214. The rollers 214 are mounted for movement around a saddle 216 which is fixed to the shaft 68. By this means, the rear wall 102 of the digging buckets 94 are positively actuated to the dumping position as each bucket is rotated to the upper and rearward portion of its circular path and is positively returned to the digging position as the bucket is rotated to the lower and forward portion of its path.

Figure 9:
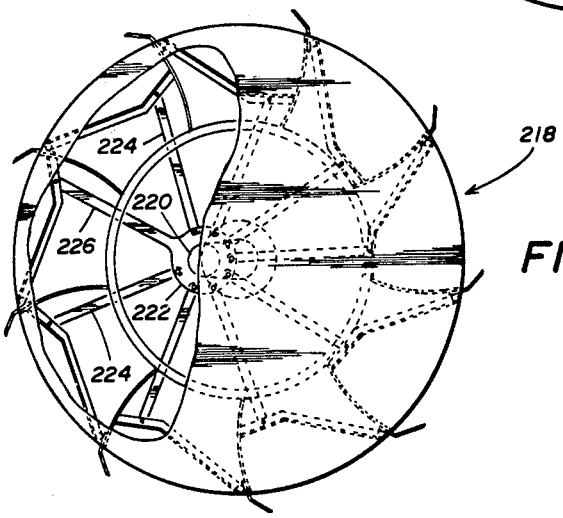

Another actuating system 218 is shown in FIG. 9. The system 218 includes a crank 220 which is fixed to the shaft 69. A collar 222 is rotatably supported on the crank 220, and a plurality of push rods 224 extend from the collar 222 to the rear walls 102 of the digging buckets 94. One of the rear walls 102 is connected to the collar 222 by a rod 226 which is fixed to the collar 222. By this means, the collar 222 is constrained to rotate with the digging wheel whereby the push rods 224 and 226 function to positively actuate the rear walls 102 to the dumping position when their respective digging buckets are in the upper and rearward portion of their travel about the shaft 68 and to positively return the rearward walls 102 to the digging position when their respective digging buckets are in the lower and forward portion of their travel.

Figure 10:
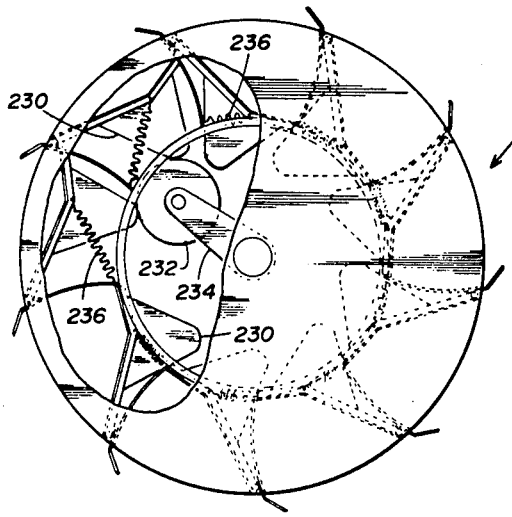

Still another actuating system 228 is shown in FIG. 10. The system 228 comprises a plurality of cams 230 each fixed to one of the rear walls 102 of the digging buckets 94. The cams 230 are positioned for engagement with a roller 232 which is supported on an arm 234 that is fixed to the shaft 68. Each rear wall 102 is also provided with a spring 236 which functions to return the rear wall 102 to the digging position. Thus, upon rotation of a particular digging bucket to bring its cam 230 into engagement with the roller 232, the rear wall 102 of the digging bucket is actuated to the dumping position. As soon as the cam 230 comes out of engagement with the roller 232, the spring 236 returns the rear wall 102 to the digging position.

Figure 11:
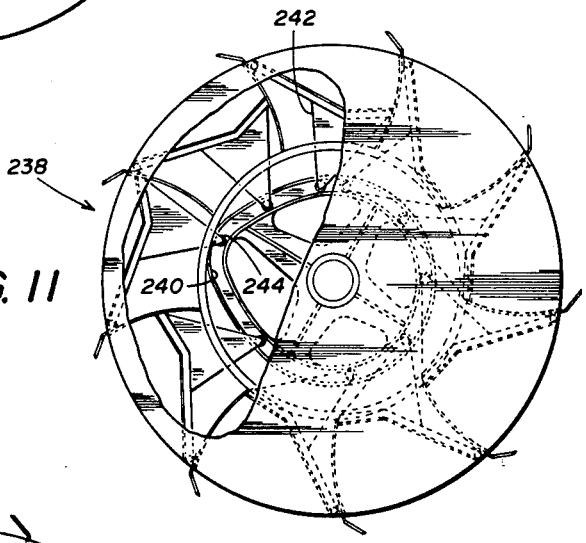

Referring now to FIG. 11, an actuating system 238 is shown. The system 238 comprises a cam track 240 which is supported on the shaft 68 and which is fixed against rotation with respect thereto. The rear wall 102 of each digging bucket 94 is equipped with a cam follower 242 including a roller 244 mounted in the cam track 240. The shape of the cam track 240 is such that each rear wall 102 is actuated to the dumping position when its digging bucket 94 is in the upper and rearward portion of its rotation about the shaft 68 and is returned to the digging position when its respective bucket 94 is in the lower and forward portion of its rotation.

Figure 12:
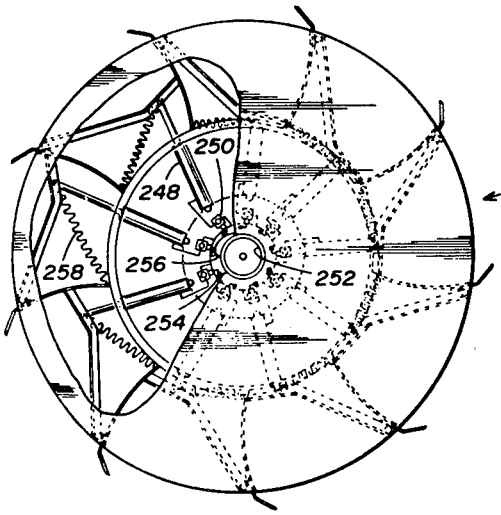

Yet another actuating system 246 is shown in FIG. 12. In accordance with the system 246, a pneumatic cylinder 248 is provided for actuating the rear wall 102 of each digging bucket 94 between the digging and the dumping positions. Each pneumatic cylinder 248 is equipped with a valve 250 for controlling the flow of compressed air from a manifold 252 to the cylinder 248. Each valve 250 is in turn equipped with a cam follower 254 which functions to open its respective valve whenever it is moved inwardly.

The cylinders 248 and their respective valves 250 are mounted for rotation about the shaft 68 with the digging buckets 94 comprising the excavating wheels. A cam 256 is supported in fixed relation to the shaft 68. Thus, as each digging bucket rotates into alignment with the cam 256, its respective cam follower 254 is actuated by the cam 256. This operates the corresponding valve 250 to admit compressed air to its pneumatic cylinder 248, whereupon the rear wall 102 is actuated to the dumping position. In a particular arrangement shown, the rear walls 102 of the digging buckets 94 are returned to the digging position by individual springs 258. However, it will be understood that the actuating system 246 may be modified to provide for return of the rear walls 102 under pneumatic action, if desired. It will be further understood that the cylinders 248 can comprise hydraulic cylinders rather than pneumatic cylinders.

Figure 13:
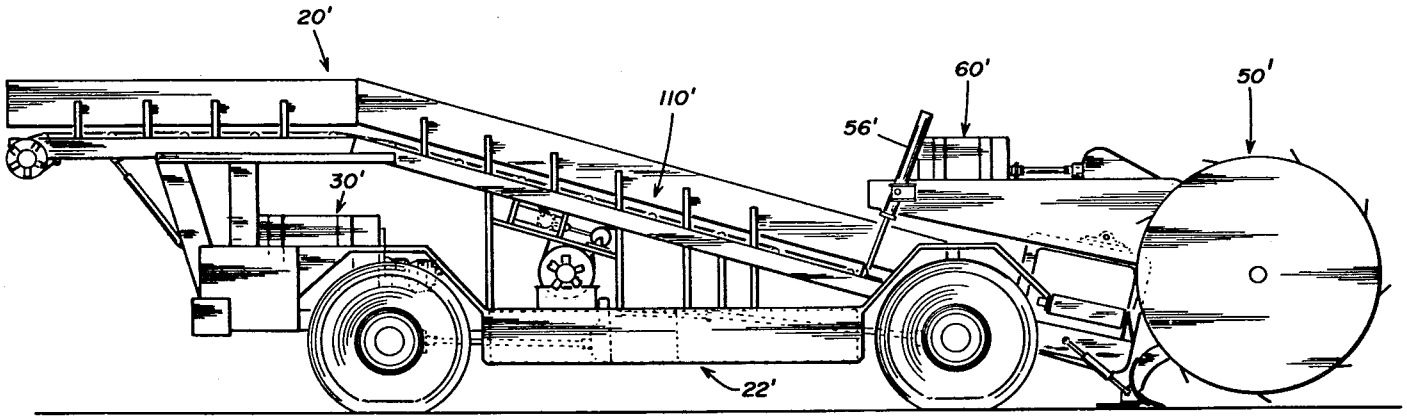
FIG. 13 is a side elevation of an excavating and loading system comprising a second embodiment of the invention.

Referring now to FIG. 13, an excavating and loading system 20′ comprising a second embodiment of the invention is shown. The excavating and loading system 20′ is similar to the excavating and loading system 20 described hereinbefore in that is comprises a vehicle 22′, an excavating system 50′, and a loading system 110′. One difference between the system 20 and the system 20′ is that the first and second engines 30 and 60 of the system 20 are replaced with electric motors 30′ and 60′ in the system 20′. Other differences are that the electric motor 60′ is positioned in a forward location and that the angular positioning of the excavating system 50′ is controlled by hydraulic cylinders 56′ which are arranged somewhat differently from the hydraulic cylinders 56 of the excavating and loading system 20. This permits the cylinders 56′ to pivot the excavating system 50′ to points above and below the highest and lowest points on the remainder of the excavating and loading system 20′ and thereby adapts the excavating and loading system 20′ to tunneling operations. The use of the excavating and loading system 20′ in tunneling operations is further facilitated by the use of the electric motors 30' and 60' whereby the emission of dangerous exhaust gases is completely eliminated.

Figure 14:
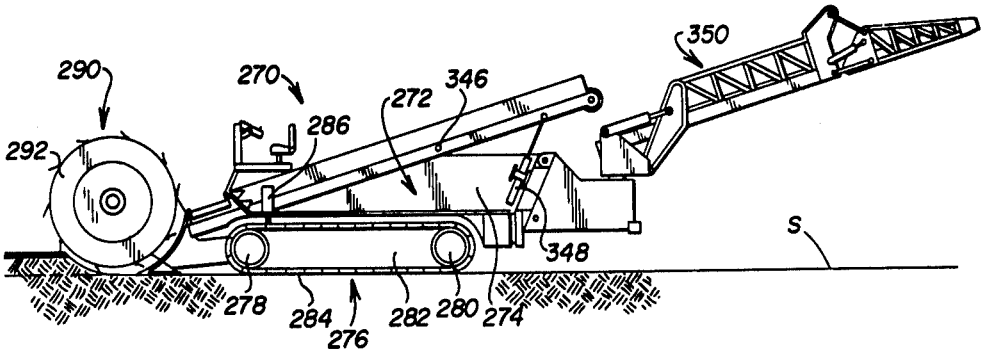
FIG. 14 is a side elevation of an excavating and loading system comprising a third embodiment of the invention.
Figure 15:
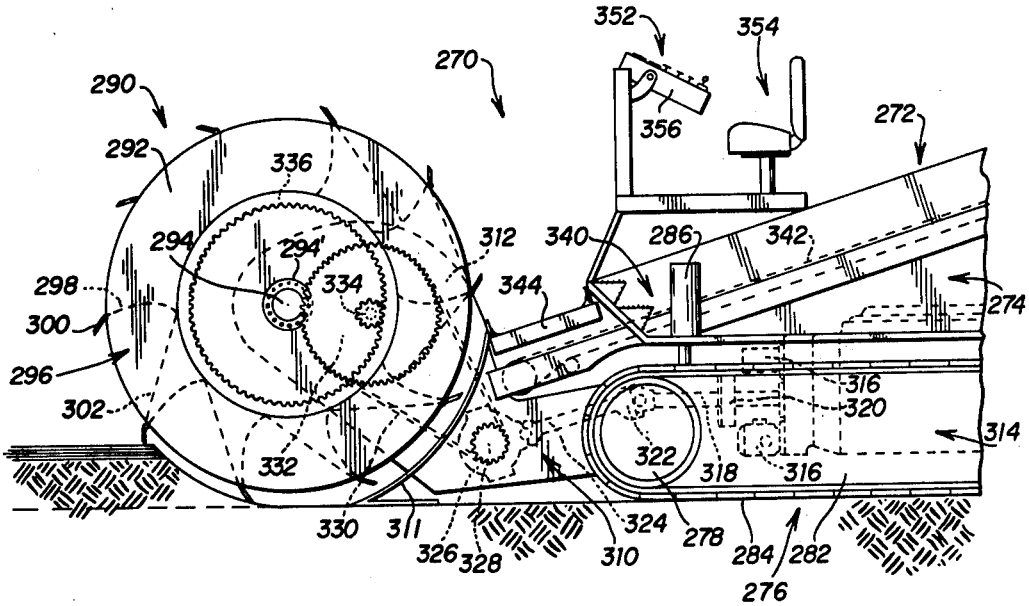
FIG. 15 is an enlarged side elevation of the forward portion of the excavating and loading system shown in FIG. 14.

Referring now to FIGS. 14 and 15, there is shown an excavating and loading system 270 incorporating a third embodiment of the invention. The excavating and loading system 270 comprises a vehicle 272 including a main frame 274 supported on a pair of opposed track assemblies 276 for movement over a surface S. The track assemblies 276 are preferably conventional in design and comprise a pair of sprockets 278 and 280 rotatably supported on a subframe 282 and in turn supporting an endless track 284. Each track assembly 276 further includes at least one motor (not shown) mounted on the subframe 282 and adapted for actuation by means of power supplied from a prime mover mounted on the vehicle 272 to propel the vehicle through one of the sprockets and the endless track 284 mounted thereon.

Each track assembly 276 is supported for pivotal movement relative to the main frame 274 of the vehicle 272 about the axis of the rear sprocket 280. A hydraulic cylinder 286 is provided on each side of the vehicle 272 and is connected between the main frame 274 of the vehicle and the subframe 282 of the adjacent track assembly 276. The hydraulic cylinders 286 are preferably actuated in tandem to control the angular relationship of the track assemblies 276 relative to the remaining components of the excavating and loading system 270.

As will be appreciated by those skilled in the art, the hydraulic cylinders 286 are typically initially actuated to lower the forward portion of the excavating and loading system 270. This causes the excavating and loading system to initiate a downwardly inclined excavation, whereby the excavating and loading system 270 digs itself into the cut or excavation to be formed. When the desired degree of inclination has been established, the hydraulic cylinders 286 are actuated to return the component parts of the excavating and loading system to the orientation illustrated in FIGS. 14 and 15, whereby the excavating and loading system continues to excavate on the established inclination until the desired depth of the excavation is reached.

The hydraulic cylinders 286 are then actuated to cause the excavating and loading system to form the bottom of the cut or excavation at a predetermined angular relationship with respect to grade. When the excavation has been finished, the excavating and loading system 270 can be removed by means of the inclination that was used to dig the excavation and loading system into the excavation. The hydraulic cylinders 286 may also be utilized to form an upwardly inclined ramp at the opposite end of the excavation, whereby the excavation and loading system 270 digs itself out of the excavation.

The excavation and loading system 270 further includes an excavating wheel assembly 290 which is preferably substantially identical in construction and operation to the excavating wheel assembly described hereinbefore in connection with the excavating and loading system 20. Thus, the excavating wheel assembly 290 comprises three excavating wheels spanning substantially continuously across the front of the vehicle 272 and having an overall width at least equal to that of the remainder of the excavating and loading system. The three excavating wheels 292 are all rotatably supported on axles 294 by suitable bushings, and each wheel 292 comprises a series of digging buckets 296 which are substantially equally spaced around the periphery of the wheel.

The digging buckets 296 of the excavating wheels 292 comprising the excavating wheel assembly 290 each comprises a fixed bucket wall 298 extending inwardly from a plurality of replaceable digging teeth 300 of the type commonly used in excavation equipment. Each bucket 296 also includes a movable wall 302 supported for pivotal movement between a material receiving position and a material discharging position. Thus, as each excavating wheel 292 is rotated, the movable wall 302 of each digging bucket 296 comprising the wheel is first positively moved to the material receiving position and is subsequently moved positively to the material discharging position. Any of the various mechanisms illustrated in FIGS. 7 through 12 inclusive may be utilized for the actuation of the movable wall 302 of the digging buckets 296 comprising the excavating wheel assembly 290 of the excavating and loading system 270.

A major distinction between the excavating system 20 illustrated in FIGS. 1 through 6 and the excavating and loading system 270 illustrated in FIGS. 14 and 15 involves the fact that the excavating wheel assembly 290 of the excavating and loading system 270 is supported on a subframe 310 which projects from the bottom of the front end of the vehicle 272 and which supports a moldboard 311. The subframe 310 includes spaced, parallel portions 312 which extend between the excavating wheels 292 comprising the excavating wheel assembly 290 and which support the excavating wheels 292 by means of the axles 294. In the embodiment of the invention illustrated in FIGS. 14 and 15, the subframe 310 is fixedly mounted on the vehicle 272, and the hydraulic cylinders 286 comprise the sole means for adjustment of the inclination of the excavation formed by the excavating and loading system 270. However, it is also contemplated that the subframe 310 may be supported on the vehicle 272 for pivotal movement under the action of suitable hydraulic actuators connected between the frame 274 of the vehicle 272 and the subframe 310.

The excavating and loading system 270 is further distinguished from the excavating and loading system 20 in that a single engine 314 mounted on the vehicle 272 is utilized to supply all of the operating power for the excavating and loading system 270. The engine 314 drives a plurality of hydraulic pumps 316, which in turn supply operating power for many of the components of the excavating and loading system. The engine 314 further has an output shaft 318 which extends through a clutch 320 to a universal joint 322. The universal joint 322 connects the shaft 318 to a shaft 324 which extends to a right angle drive 326. The right angle drive 326 actuates a pair of relatively small diameter sprockets 328 which are coupled through a pair of chains 330 to a pair of relatively large diameter sprockets 332. The sprockets 332 drive a series of pinions 334 which are mounted in mesh with ring gears 336 secured on the excavating wheels 292. By this means the output of the engine 314 is directly coupled to the excavating wheel assembly 290 through a drive train extending in part through the subframe 310 and hence between the three excavating wheels 292 comprising the excavating wheel assembly.

It will be understood that the spaced, parallel portions 312 of the subframe 310 comprise hollow box-like members of the type illustrated in FIGS. 2, 3 and 6 in conjunction with the excavating and loading system 20. The spaced, parallel portions 312 therefore serve not only to support the excavating wheel assembly 290, but also to enclose the sprockets 328, the chains 330, and the sprockets 332 of the drive system for the excavating wheel assembly.

A major design feature of the excavating and loading system 270 involves the fact that the excavating wheel assembly 290 is supported on the subframe 310 by means of three axles 294 which are secured to the spaced, parallel portions 312 of the subframe 310 by means of flanges 294', and suitable fasteners. This leaves the interiors of the spaced, parallel portions 312 entirely open, whereby the diameters of the sprockets 332 may be selected to provide the particular speed and torque inputs to the excavating wheel assembly 290 that are required for a given excavating situation. On the other hand, if a single axle extending the entire width of the excavating wheel assembly were to be used, the maximum diameter of the sprocket 332 would be substantially restricted.

The ability to vary the speed and torque inputs to the excavating wheel assembly 290 by changing the sprocket wheels 332 has been found to comprise a substantial advantage. Thus, the operation is carried out quite easily by merely exchanging the sprockets 332 and adjusting the lengths of the chains 330. Moreover, changing the sprockets 332 does not affect the design criteria of the upstream components of the drive train. On the other hand, if another component of the drive train were to be changed in order to provide required torque and speed inputs to the excavating wheel assembly 290, various downstream components might also have to be changed in order to accommodate increased loads.

The excavating and loading system 270 further includes a loading system 340. The loading system 340 comprises a main conveyor 342 which receives excavated material directly from the center excavating wheel 292 of the excavating wheel assembly 290 and which transports the excavated material upwardly and rearwardly to a discharge point at the extreme rear end of the vehicle 272. The system 340 further includes a pair of cross conveyors 344 which receive excavated material from the two outside excavating wheels 292 of the excavating wheel assembly 290 and which transport the material to the main conveyor 342. As is best shown in FIG. 14, the rear portion of the main conveyor 342 is selectively pivotable about the axis of a pin 346 under the action of hydraulic cylinders 348 mounted on the opposite sides of the vehicle 272.

The excavating and loading system 270 may also be provided with an auxiliary conveyor system 350. In such instances, the auxiliary conveyor system 350 is connected to the extreme rear end of the frame 274 of the vehicle 272 and is utilized either to discharge the excavated material into trucks or other vehicles or to discharge the excavated material laterally with respect to the excavation being formed. The auxiliary conveyor system 350 is preferably identical in construction and operation to the auxiliary conveyor system 150 described in detail hereinbefore in conjunction with the excavating and loading system 20.

An additional feature of the excavating and loading system 270 comprises an operator's compartment 352 positioned at the top of the front end of the vehicle 272 to facilitate concurrent observation of all of the operating instrumentalities of the excavating and loading system 270. The operator's compartment 352 includes the usual operator's seat 354 and a console 356 comprising the usual gauges, switches and controls which are necessary for complete regulation of the operation of the excavating and loading system 270.

FIGS. 14 and 15 further illustrate an alternative usage of excavating and loading systems incorporating the invention. As will be appreciated by those skilled in the art, the excavating wheels 292 of the excavating wheel assembly 290 are so constructed that the orientation of the center excavating wheel may be reversed with respect to the axle 294. Similarly, the outside excavating wheel 292 which is usually positioned on the right-hand side of the vehicle 272 may be mounted on the left-hand side thereof, and the excavating wheel 292 which is usually mounted on the left-hand side of the vehicle may be mounted on the right-hand side thereof. At the completion of these steps, the excavating wheels 292 comprising the excavating wheel assembly 290 are oriented as shown in FIGS. 14 and 15. It will be noted that the orientation of the mechanism which actuates the movable walls 302 of the digging buckets 296 of the excavating wheels is preferably not changed as the orientation of the excavating wheels 292 is reversed. Thus, even though the excavating wheels rotate in the reverse direction, the movable wall 302 of each digging bucket 296 continues to be positively moved to the material receiving position as the digging bucket moves through the lower forward portion of its rotation and to be positively moved to the material discharging position as the digging bucket is moved through the upper rearward portion of its rotation.

The orientation of the excavating wheels 292 of the excavating wheel assembly 290 in the manner illustrated in FIGS. 14 and 15 is considered to be particularly advantageous for the excavation of asphalt paving and similar materials. Thus, with the excavating wheels so oriented, the digging teeth 300 of the digging buckets 296 are moved downwardly and therefore engage the pavement or similar material from above. This produces an anvil effect so that the material is removed in the form of small pieces which are readily handled both by the excavating and loading system 270 and by the trucks or other vehicles which will be utilized to receive the excavated material. Conversely, if the excavating wheels 292 of the excavating wheel assembly 290 were operated in the conventional manner with the teeth 300 moving upwardly, the asphalt pavement or similar material might tend to break away in the form of large plate-like sections. Such sections have proven to be difficult to handle unless they are first further reduced to relatively small pieces.

Figure 16:
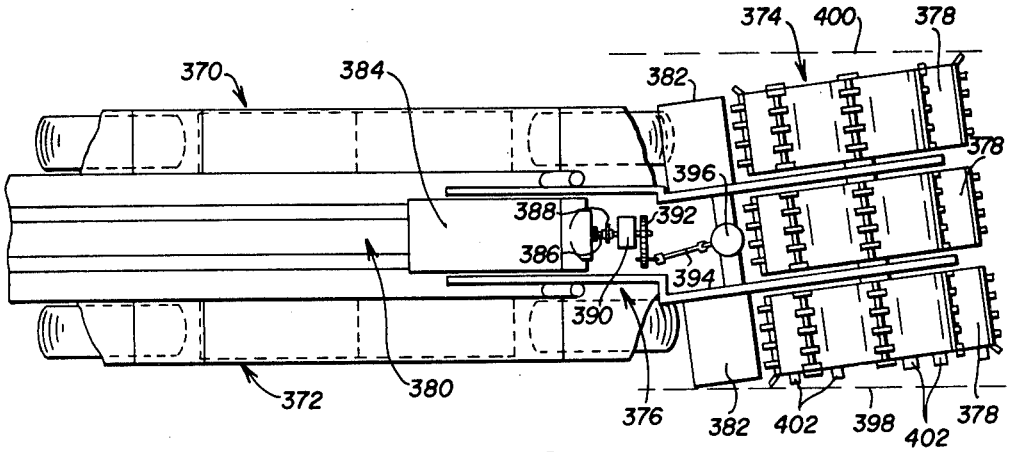
FIG. 16 is a plan view of the forward portion of an excavating and loading system incorporating a fourth embodiment of the invention.

Referring now to FIG. 16, there is shown an excavating and loading system 370 comprising a fourth embodiment of the invention. The excavating and loading system 370 comprises a vehicle 372 which is preferably substantially identical in construction and operation to the vehicle 22 described hereinbefore in conjunction with the excavating and loading system 20. An excavating wheel assembly 374 is supported at the front end of the vehicle 372 by means of a subframe 376. The excavating wheel assembly 374 comprises three excavating wheels 378 extending substantially continuously across the front of the vehicle 372 and having an overall width at least equal to that of the remainder of the system. The excavating wheels 378 are preferably substantially identical in construction and operation to the excavating wheels utilized in the excavating and loading system 20.

In the operation of the excavating and loading system 370, material excavated by the center excavating wheel 378 is discharged onto a main conveyor 380 and is transported thereby to a discharge point at the rear of the vehicle 372. Material excavated by the two outside excavating wheels 378 is discharged onto a pair of cross conveyors 382 which in turn discharge the excavated material onto the main conveyor 380. The excavating and loading system 370 may also be provided with an auxiliary conveyor system similar to the auxiliary conveyor system 150 of the excavating and loading system 20, if desired.

The major distinction between the excavating and loading system 370 and the excavating and loading system 20 comprises the fact that the axis of rotation of the three excavating wheels 378 comprising the excavating wheel assembly 374 is angularly offset with respect to a line extending perpendicularly to the longitudinal axis of the vehicle 372. This has been found to be advantageous in the excavation of relatively hard materials in that it prevents the formation of ridges in the spaces between the excavating wheels comprising the excavating wheel assembly. The cross conveyors 382 are also angularly offset so as to be properly positioned to receive material excavated by the two outside excavating wheels 378. Nevertheless, the cross conveyors 382 discharge the excavated material onto the main conveyor 380 which extends parallel to the longitudinal axis of the vehicle 372.

The excavating wheel assembly 374 of the excavating and loading assembly 370 is driven by an engine 384 which is mounted on the subframe 376 and which is positioned so as to counterbalance the weight of the excavating wheel assembly 374. The engine 384 has an output shaft 386 which is coupled through a clutch 388 to a speed reducer 390 and hence to a chain drive 392. The chain drive 392 is in turn coupled through a shaft 394 to a right angle drive 396. The right angle drive 396 in turn functions to rotate the excavating wheels 378 of the excavating wheel assembly 374 by means of a pair of chain and sprocket drive mechanisms extending between the excavating wheels 378.

Those skilled in the art will appreciate the fact that due to the angularly offset positioning of the excavating wheel assembly 374, the excavating and loading system 370 functions to form an excavation extending between a plane 398 and a plane 400. This presents no problem except for the fact that the portion of the excavation adjacent the plane 398 is formed entirely by the outside teeth of the excavating wheel 378 adjacent thereto. To this end, the circular outside surface of the excavating wheel 378 adjacent the plane 398 may be provided with auxiliary cutting teeth 402 which function to assist in the formation of the adjacent portion of the excavation.

Figure 17:
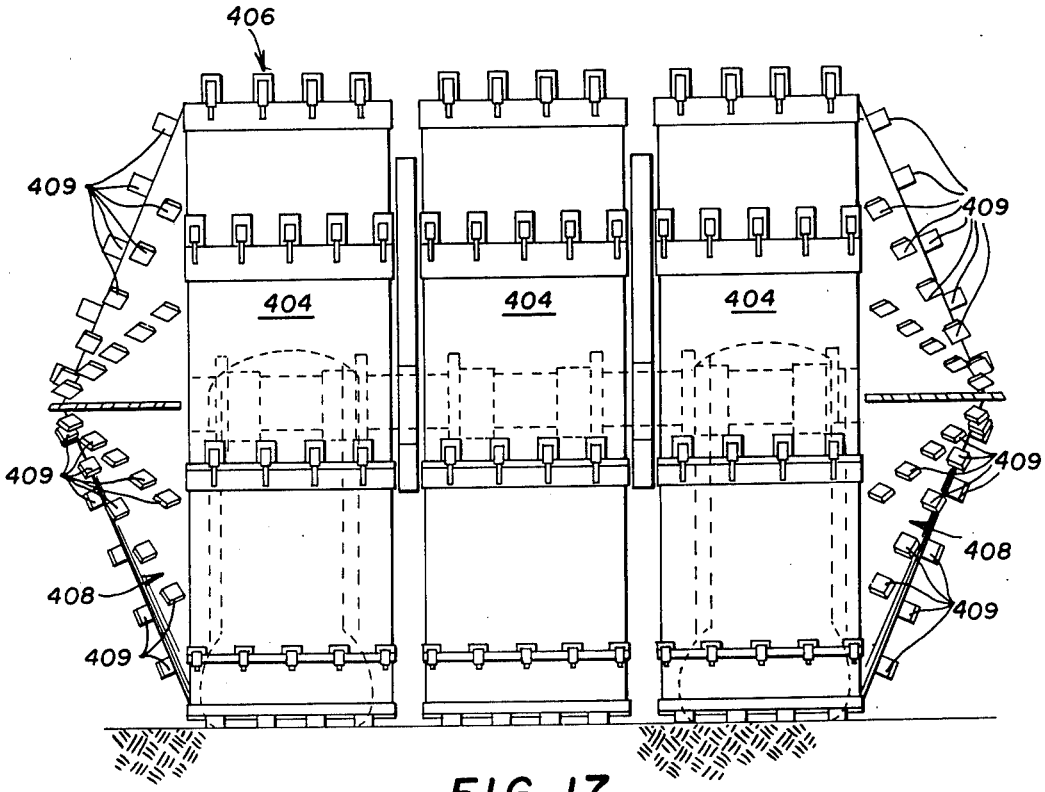
FIG. 17 is a front elevation of conical cutter members which may be utilized in conjunction with any of the various embodiments of the invention.

FIG. 17 illustrates an accessory which may be utilized in conjunction with any of the various embodiments of the invention described hereinbefore. Thus, the outside excavating wheels 404 of an excavating wheel assembly 406 incorporating the invention may be provided with conical cutter members 408. The cutter members 408 are detachably mounted and are preferably provided with replaceable cutting teeth 409 of the type commonly utilized in excavating machines of various types.

The purpose of the cutter members 408 is to form tapered side walls on the opposite edges of a cut or excavation formed by the excavating wheel assembly 406. Assuming that the overall depth of the excavation does not exceed the radius of the excavating wheels 404, the side walls of the excavation will be tapered from top to bottom. On the other hand, if the total depth of the excavation exceeds the radius of the excavating wheels 404, only the lower portion of the side walls of the excavation will be tapered. In either event, it is often advantageous to provide tapered side walls on an excavation, particularly in those instances in which the material being excavated does not have sufficient substance to retain a vertical side wall configuration.

Figure 18:
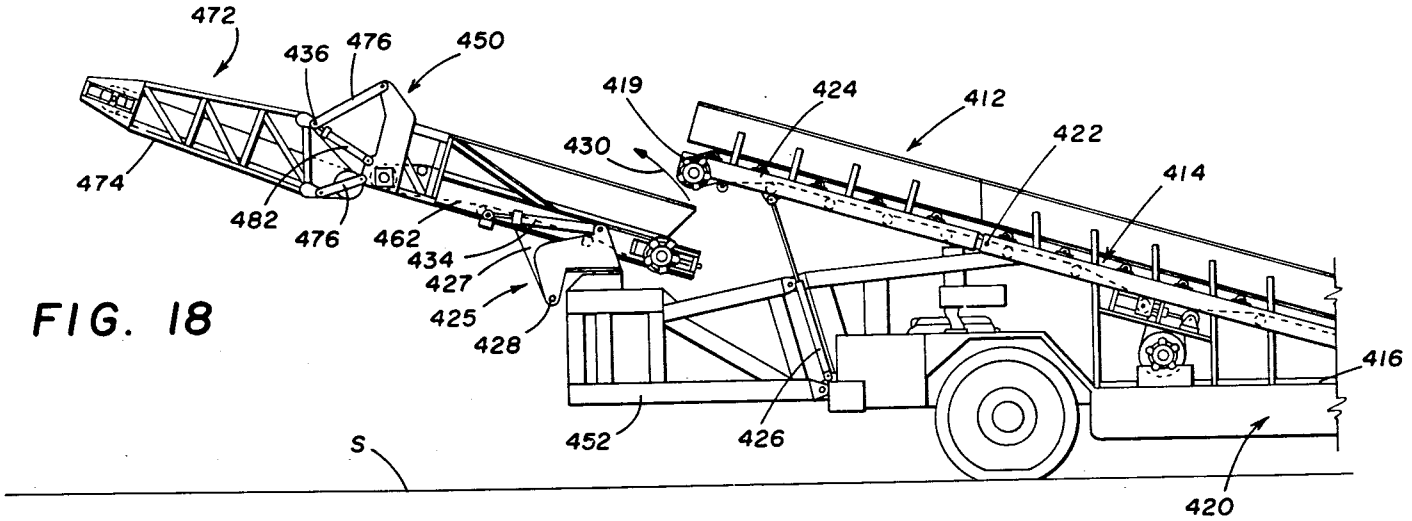
FIGS. 18, 19 and 20 are partial side elevations of the conveyor folding apparatus of the invention.
Figure 19:
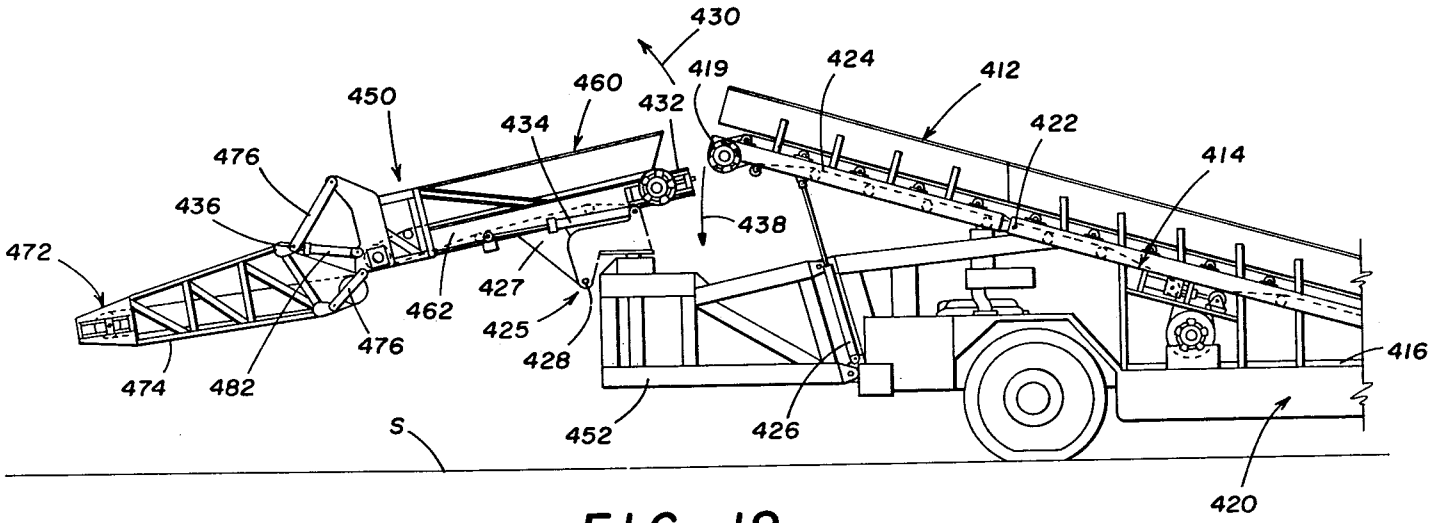
Figure 20:
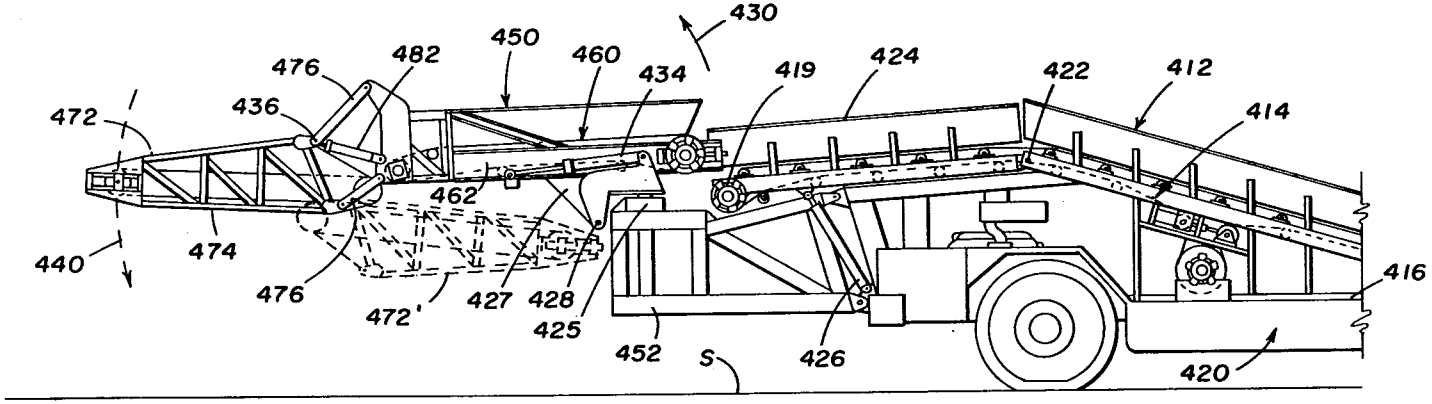

FIGS. 18, 19 and 20 illustrate an alternate embodiment of the excavating and loading system incorporating the present invention. As will be appreciated by those of skill in the art, the rear portion of the conveyors of an excavating and loading system 420 is illustrated. This excavating and loading system 420 can be utilized with any of the excavating wheels previously illustrated and described. The system 420, in addition, has a main conveyor 412 similar to the one illustrated and described in reference to FIGS. 1 through 6. As was previously pointed out, the main conveyor 412 has a conveyor frame 414 supported on a main vehicle frame 416. The conveyor frame 414 includes an upper portion 424 supported for pivotal movement about a horizontal axis 422 under the action of hydraulic cylinder 426. This permits control over the vertical position of the material discharge end 419 of the upper conveyor portion 424.

The loading system 420 also includes a turntable assembly 425 supported on frame 452. Turntable assembly 425 supports an auxiliary conveyor assembly 450 identical to the auxiliary conveyor illustrated in FIGS. 1 through 6. Conveyor assembly 450 includes an inner conveyor 460 for receiving material discharged at the material discharge end 419 of the main conveyor 412. The conveyor 460 comprises a frame 462 with flanges 427 which extend down and are pivotally attached at 428 to the turntable assembly 425. This pivotal attachment at 428 allows rotation of the auxiliary conveyor 450 in the forward and reverse direction of arrow 430 to allow the raising and lowering of the material receiving end 432 of auxiliary conveyor assembly 450. A hydraulic cylinder 434 is provided for causing the frame 462 to rotate about pivot 428.

The auxiliary conveyor system 450 can include an outer conveyor 472 having a frame 474, which is supported from the frame 462 of the conveyor 460 by a pair of parallel links 476. A hydraulic cylinder 482 extends between the frame 462 of conveyor 460 and the frame 474 of the conveyor 472 for actuation to manipulate the conveyor 472. The upper link 476 and the cylinder 482 are pivotally connected to frame 474 by a selectively removable pin 436.

The particular conveyor configuration illustrated in FIGS. 18 through 20 has important advantages which can be appreciated when it is considered that the size of the system 420 in some applications can be substantial. It is important to note that the discharge end 419 of the upper portion 424 of the main conveyor 412 can extend to substantial heights. In addition, the clearance height of the auxiliary conveyor 450 can be considerable when it is understood that the conveyor is designed to extend to a height substantially above a material transporter. This height can present problems in the transportation of the excavating and loading system 420 from one site to another. This is particularly important when overhead clearance is limited.

In FIG. 18, the system is shown in its fully-extended position, but according to the particular feature of the present invention, the conveyors 412 and 450 are adapted to be folded to a minimal clearance configuration. The folding of the conveyors to a minimal clearance configuration is illustrated in FIGS. 19 and 20.

The first step in the folding operation is illustrated in FIG. 19. In this Figure, hydraulic cylinder 434 is actuated to rotate the auxiliary conveyor 450 in the direction of arrow 430, thus moving material receiving end 432 upward and to the rear. This position is illustrated in FIG. 19, the conveyor 450 positioned out of the folding path of conveyor 412. Hydraulic cylinder 426 is then actuated to rotate the material discharge end 419 of the upper conveyor portion 424 of the main conveyor 412 through a folding path in the direction of arrow 438. This movement continues until the discharge end 419 reaches the folded position illustrated in FIG. 20. The auxiliary conveyor 450 is then rotated by hydraulic cylinder 434 from the position illustrated in FIG. 19 to the position illustrated in FIG. 20 with the material receiving end 432 adjacent to and positioned above the discharge end 419. In this manner, the material discharge end 419 is substantially lowered in height below the auxiliary conveyor assembly 450, thus reducing the clearance required to transport the excavating and loading system 420.

The auxiliary conveyor 450 is also particularly adapted to facilitate transportation of the excavating and loading system 420. This is accomplished by disconnecting the outer conveyor 472 and rotating the same to the position 472' illustrated in FIG. 20. This folding of the outer conveyor 472 is accomplished by removing the pins 436 which allows the outer conveyor 472 to rotate in the direction of arrow 440 up under the frame of the inner conveyor 460 where a suitable latching means (not shown) is utilized to retain the outer conveyor 472 in the folded position.

It will be appreciated that the folding of the conveyors as illustrated in FIGS. 18 through 20 provide particular advantage in the reduction of the clearance required for transporting the system 420 and reduces the rearward extension of the conveyor.

Figure 21:
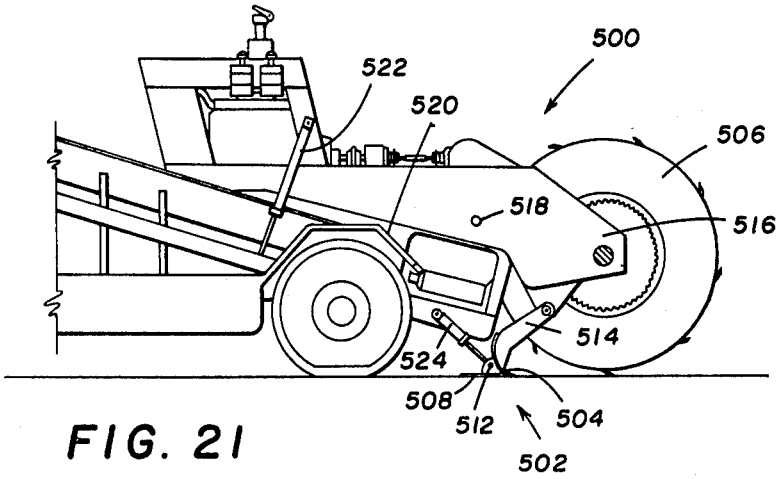
FIG. 21 is a partial side elevation of a second moldboard assembly incorporating the invention.

Referring now to FIG. 21, there is shown a forward portion of an excavating and loading system 500 with a moldboard assembly 502 mounted thereon. Those of ordinary skill in the art will appreciate that this embodiment of the moldboard assembly 502 and the other embodiments hereinafter disclosed have particular advantages when used with excavating and loading systems of the type disclosed herein where a large heavy excavating wheel assembly is mounted on a subframe which is cantilevered from the front of the main vehicle frame. This heavy excavating wheel assembly creates vertical loads as the vehicle translates during the excavating process. In addition, digging resistance on the excavating wheel assembly varies as different types of material are encountered by the excavating wheel. This will also create variable vertical loads which will tend to create a rocking or bouncing motion of the frame of the vehicle. This problem is further complicated when the excavating loading system is operated in a soft soil allowing the wheels to sink in the soil as the vertical loads are generated.

To counter this action, the moldboard assemblies incorporating the present invention utilize a drag plate which is positioned between the excavating wheel and the front of the vehicle frame and is designed to counteract these undesirable vertical loads by contacting the soil surface. In some embodiments, this contact pressure is increased and decreased as the grade on which the excavating and loading system is excavating varies. In addition, means are provided for varying the vertical pressure of the drag plate.

The moldboard assembly 502, shown in FIG. 21, has a blade portion 504 extending across the width of the system 500. The blade 504 is positioned below and to the rear of the excavating wheel assembly 506 to pick up material dropped from the wheel assembly 506. In addition, if the wheel assembly 506 is configured, as illustrated in FIG. 3 with a plurality of spaced excavating wheels, ridges will be formed between the individual wheels during the excavation operation. In operation, the blade 504 will cut the ridges formed between the excavating wheels to provide a smooth-bottomed excavation. The blade 504 is a concave surface which crowds material forward until it is picked up by the excavating wheel assembly 506.

An additional function performed by the moldboard assembly 502 is in stabilizing the excavating and loading system 500 during operation. This is accomplished by drag plate 508, sometimes called a drag shoe. The drag plate 508 is mounted behind the blade 504 and is positioned to contact the ground surface. The plate 508 supports the vertical component of the excavating wheel assembly's digging force and serves to stabilize the excavating and loading system 500 and resist vertical bouncing action.

Figure 27:
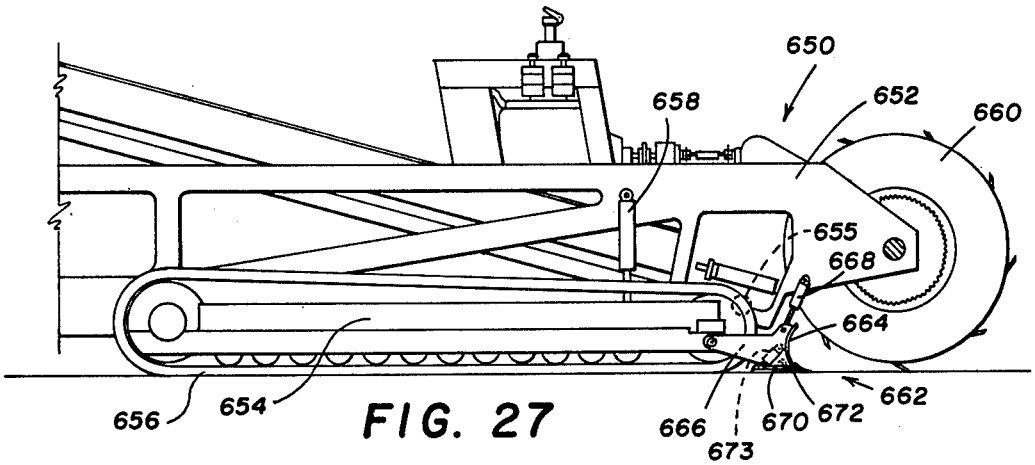
FIG. 27 is a side elevation of a fifth moldboard assembly incorporating the invention.

As those of ordinary skill in the art will appreciate, the position of the blade 504 and the plate 508 must vary as the direction of the operation of the excavating and loading system 500 changes. To accommodate these changes, the blade 504 and plate 508 are rigidly attached together by a flange 512. It is envisioned that the blade 504 and plate 508 could alternatively be connected as illustrated in FIG. 27. This flange 512 prevents angular changes between the orientation of the blade 504 and plate 508 with respect to each other. A pair of link arms 514 are pivotally connected to the subframe 516. The subframe is in turn supported from a shaft 518 to rotate about a horizontal axis with respect to the main frame 520 of the excavating and loading system 500. A pair of hydraulic cylinders 522 are provided to rotate the subframe 516 with respect to the main frame 520.

A pair of hydraulic cylinders 524 are connected between the main frame 520 and the flange 512 for rotating the link arms 514 with respect to the subframe 516. Thus, by selectively actuating hydraulic cylinder 524, the relative orientation between the blade 504 and plate 508, and the excavating wheel assembly 506 can be adjusted by the operator of the vehicle. The cylinders 524 preferably extend angularly outwardly from the frame 520 to the flanges 512 so as to stabilize the moldboard assembly 502 against lateral movement.

Figure 22C:
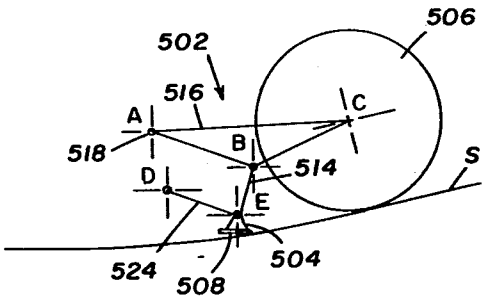
FIGS. 22*a*, 22*b* and 22*c* are diagrams illustrating the operation of the moldboard assembly of FIG. 21.
Figure 22B:
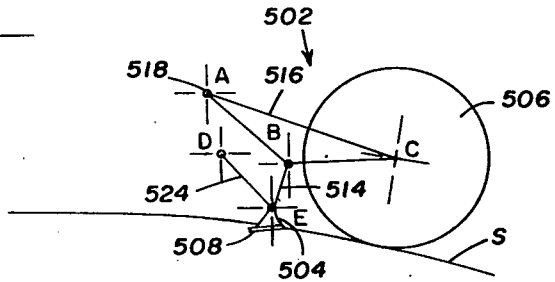
Figure 22A:
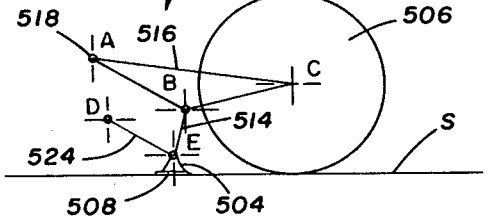

The particular configuration illustrated in FIG. 21 provides advantages inherent in the operation of the moldboard assembly 502 which those of ordinary skill in the art will appreciate by referring to FIGS. **22*a*, 22*b* and 22*c*. In FIGS. 22*a*, 22*b* and 22*c*, a simplified link diagram of the operation of the moldboard assembly 502** in various cutting applications is illustrated.

In these Figures, the circular outline represents the excavating wheel assembly 506. The triangular link defined by points A, B and C represents the subframe 516. Point "A" represents the shaft 518 connecting the subframe 516 and the main frame 520. The point "C" represents the axis of rotation of the excavating wheel assembly 506 with respect to the subframe 516. Line "B-E" represents link arms 514 which support the blade 504 and plate 508. The point "B" represents the pivotal connection between the arm 514 and the subframe 516. The link "D-E" represents hydraulic cylinders 524. The point "D" represents the pivotal connection of the cylinder 524 to the main frame 520 while the point "E" represents pivotal connection between the cylinder 524 and the flange 512 on the blade 504 and drag plate 508.

In FIG. 22*a*, the use of the excavating and loading system 500 and operation of the moldboard assembly 502 in forming a level cut is illustrated. In this application the drag plate 508 is relatively parallel to and flush with the ground surface S. A plate 508 presses against the surface S and provides vertical support for the excavating wheel assembly 506. The link "D-E", representing a hydraulic cylinder 524, can be adjusted in length to compensate for plate wear or so that the support pressure of the drag plate 508 can be adjusted to suit the soil conditions.

The particular advantages of the embodiment of FIG. 21 are also illustrated in FIGS. 22*b* and 22*c*. In these Figures, the grade of the excavation is greatly exaggerated to better illustrate the desired angular relationship of the excavating wheel assembly 506 and moldboard assembly 502.

In FIG. 22*b*, the apparatus is used to dig along a downgrade. The particular geometric relationship of the moldboard causes the plate 508 to be automatically depressed relative to the surface S, thus stabilizing the system as the excavation progresses. In FIG. 22*c* the system 500 is illustrated digging along an upgrade. In this situation it can be seen that the drag plate 508 of the blade is raised relative to the surface, thus relieving drag. These configurations, illustrated in FIGS. 22*a*, 22*b* and 22*c*, are automatically provided by the geometry of the apparatus as the relative wheel digging elevation is changed.

This operation is the result of the use of a four-bar type linkage wherein the links AB and DE are approximately parallel and where the blade 504 and plate 508 are fixed relative to the link BE.

Thus, it can be seen that a moldboard assembly 502 is provided with a blade which is raised and lowered in an amount proportional to the raising and lowering of the excavating wheel assembly 506. In addition, the drag plate increases the vertical pressure on a downgrade and decreases the pressure on an upgrade.

Figure 23:
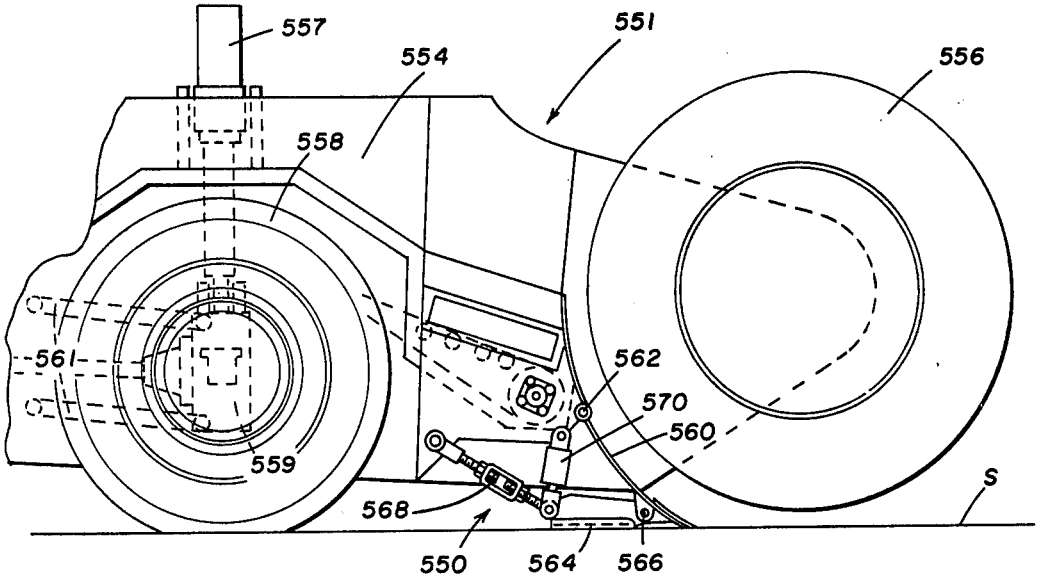
FIGS. 23 and 24 are partial side elevations of a third moldboard assembly incorporating the invention.
Figure 24:
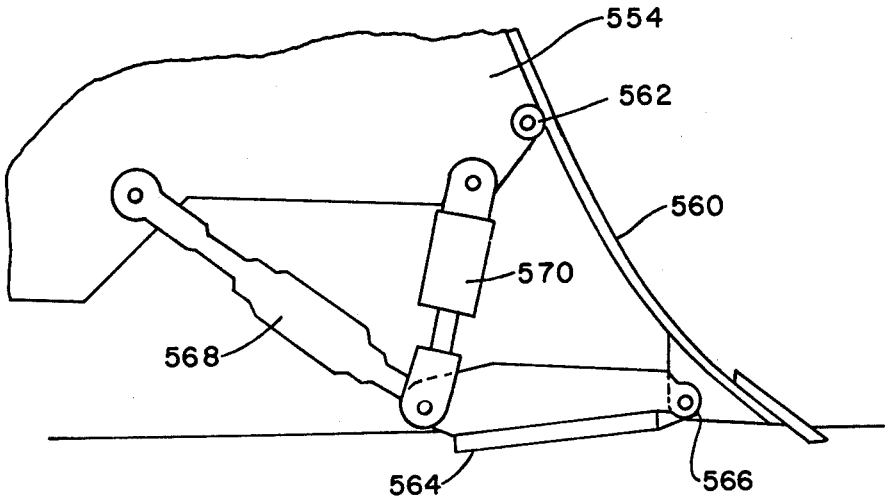

In FIGS. 23 and 24, a third embodiment of a moldboard assembly incorporating the present invention is illustrated. The moldboard assembly 550 is supported from a rigid frame type excavating and loading system 551. The rigid frame system 551 is of the type having a subframe 554 which supports the excavating wheel assembly 556. The front wheels 558 are provided with a frame 559 movably connected to subframe 554 by arms 561. The rear wheels (not shown) are rotatably connected to subframe 554. A hydraulic cylinder 557 is connected between frame 559 and subframe 554. By controlling the operation of cylinder 557, the height of subframe 554 with respect to the frame 559 can be adjusted.

The moldboard assembly 550 is connected to the frame 554, as illustrated in FIG. 23. The embodiment utilizes an elongated blade 560, which is pivotally attached at 562 behind excavating wheel assembly 556. A drag plate 564 is pivotally attached at 566 to the blade 560. A turn buckle 568 is pivotally attached between the drag plate 564 and the frame 554. A selectively operable hydraulic cylinder 570 is connected between the frame 554 and the plate 564.

The moldboard assembly 550 is mounted on the frame of the excavating wheel assembly 556 and can be raised and lowered as the excavating wheel is raised and lowered. The orientation of the blade is not varied by the raising and lowering of the excavating wheel assembly 556. The position of the blade 560 and the drag plate 564 are selectively controlled by operation of hydraulic cylinder 570. In FIG. 24, operation of the moldboard assembly 550 is illustrated. The cylinder 570 is actuated and elongated, thus moving the blade 560 down. This downward movement also moves the drag plate 564 downward increasing the pressure on the plate. It is apparent that if the cylinder 570 is shortened, the blade 560 will be raised and the drag plate pressure will be reduced.

Figure 25:
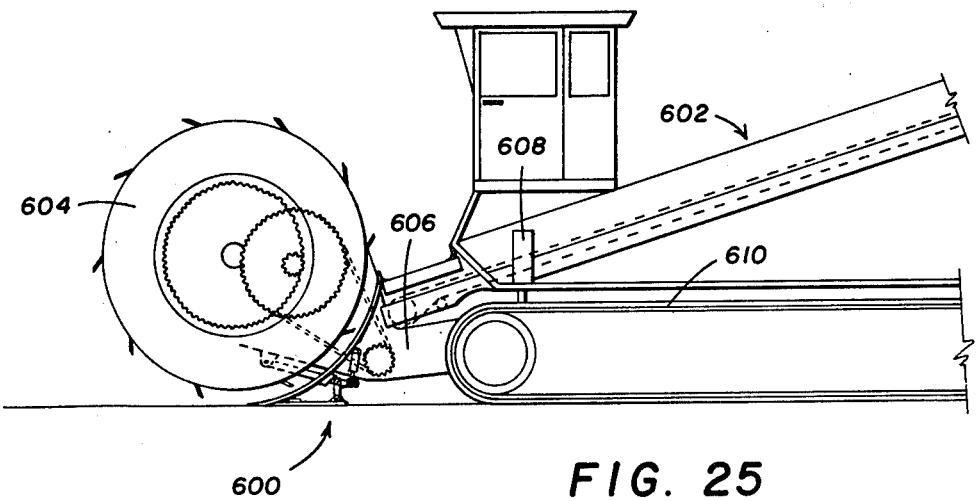
FIGS. 25 and 26 are side elevations of a fourth moldboard assembly incorporating the invention.
Figure 26:
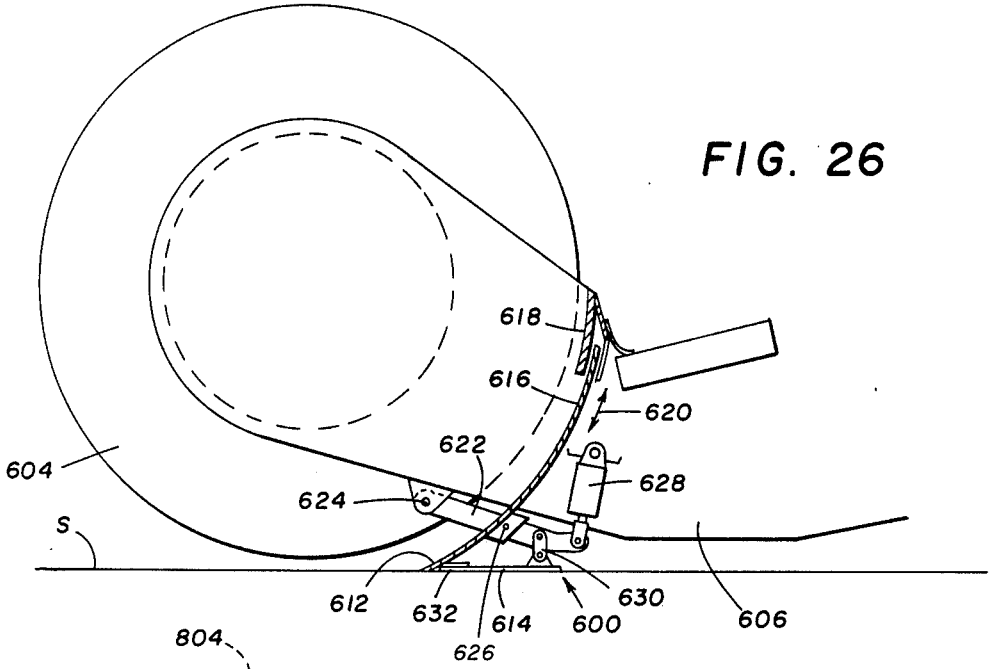

In FIGS. 25 and 26, a fourth embodiment of a moldboard assembly 600 incorporated in the present invention is illustrated. The moldboard assembly 600 is specifically adapted for mounting on another fixed frame type system. The moldboard assembly 600 is mounted on an excavating and loading system 602 which is identical in construction to the vehicle illustrated in FIGS. 14 and 15. As was previously described, the excavating wheel assembly 604 is supported from a frame 606, which is connected by hydraulic cylinder 608 to a track assembly 610. The excavating wheel assembly 604 is raised and lowered with respect to the track assembly 610 by means of a hydraulic cylinder 608.

In FIG. 26, the details of the moldboard assembly 600 are illustrated. A blade 612 and a fixed position bearing plate 614 are provided on the assembly 600. The upper end 616 of the blade 612 is restrained in a slot 618 of the frame 606. The end 616 is retained in the slot and is allowed to move in the slot in the forward and reverse directions of arrow 620. A pair of link bars 622 are pivotally connected to the frame 606 at 624 and pivotally connected to the blade 612 at 626. Hydraulic cylinders 628 are connected between the frame 606 and extending ends of the links 622. Links 630 are pivotally connected between the links 622 and the rear of the bearing plate 614.

It will be apparent to those of ordinary skill in the art that by operation of the hydraulic cylinder 628, the blade 612 will be caused to move in the forward and reverse directions of the arrows 620 and be restrained by the slot 618. The bearing plate 614 will move in a likewise manner.

It is to be pointed out that the moldboard assembly 600, illustrated in FIGS. 25 and 26, operates in a manner similar to the moldboard assembly illustrated in FIGS. 23 and 24. The moldboard assembly 600 is raised and lowered with the excavating wheel assembly 604 as the frame 606 is raised and lowered. The blade edge and drag plate positioned on the blade are controlled by a hydraulic cylinder and can be operated to increase drag plate pressure as the blade is lowered.

It is also envisioned that the bearing plate 614 could be connected to blade 612 at 632 in a manner which permits angular freedom between the plate and the blade.

FIG. 27 illustrates a fifth embodiment of a moldboard assembly incorporating the present invention. In this embodiment, an excavating and loading system 650 is illustrated having a subframe 652 and a wheel frame 654 supporting treaded wheels 656. The subframe 652 is pivotally connected to wheel frame 654 at pivot 655.

A hydraulic cylinder 658 is provided selectively to raise and lower the subframe 652 with respect to the wheel frame 654. This in turn controls the digging height of the excavating wheel assembly 660 supported from frame 652.

The moldboard assembly 662 has a blade 664 which is rigidly carried by a pair of arms 666. Arms 666 are pivotally mounted on the wheel frame 654 and a pair of hydraulic cylinders 668 connect the arms 666 to the frame 652. By selectively actuating the hydraulic cylinders 668, the position of the arms 666 and blade 664 can be varied.

The drag plate 670 is pivotally attached at 672 to the rear of the blade 664. A second pair of hydraulic cylinders 673 are connected between the drag plate 670 and the arms 666 to pivotally adjust the relative position of the drag plate 670 with respect to the blade 664. This provision of pivotal adjustment of the plate 670 could also be used with the embodiment illustrated in FIG. 21.

In operation, as the frame 652 is raised and lowered, the geometry of the moldboard assembly 662 is such that the blade 664 and plate 670 are raised and lowered proportional to the amount that the frame 652 and excavating wheel assemblies 660 are raised and lowered. The geometry is such that the drag plate bears with decreased pressure as the blade is lowered and with increased pressure as the blade is raised. In addition, a separate control for the position of the drag plate is used.

Figure 28A:
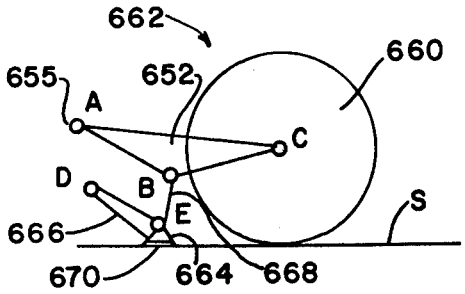
FIGS. 28*a*, 28*b* and 28*c* are diagrams illustrating the operation of the moldboard assembly of FIG. 27.
Figure 28B:
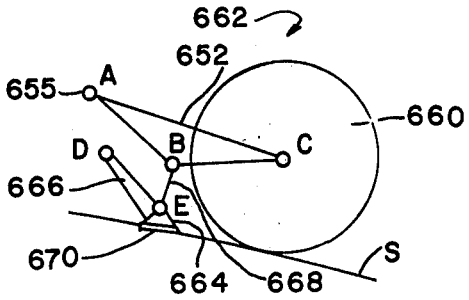
Figure 28C:
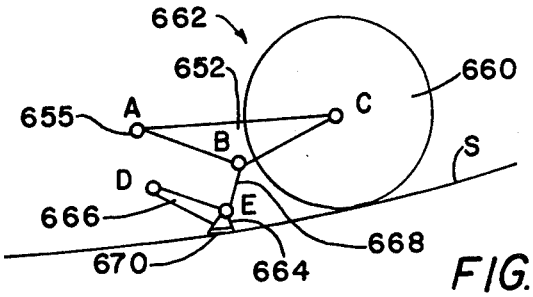

The particular configuration illustrated in FIG. 27 provides advantages inherent in the operation of the moldboard assembly 662 which those of ordinary skill in the art will appreciate by referring to FIGS. 28*a*, 28*b*, and 28*c*. In FIGS. 28*a*, 28*b*, and 28*c*, a simplified link diagram of the operation of the moldboard assembly 662 in various cutting applications is illustrated.

In these Figures, the circular outline represents the excavating wheel assembly 660 and the triangular link defined by points A, B, and C represents the subframe 652. Point "A" represents the pivot 655 connecting the subframe 652 and the frame 654. The point "C" represents the axis of rotation of the excavating wheel assembly 660 with respect to the subframe 652. Link "D-E" represents link arms 666 which support the blade 664 and plate 670. The link "B-E" represents hydraulic cylinders 668. The point "B" represents the pivotal connection between the subframe 652 and the cylinders 668. The point "D" represents the pivotal connection of the arms 666 to the frame 654 while the point "E" represents pivotal connection between the cylinder 668 and the link arms 666.

In FIG. 28*a*, the use of the excavating and loading system 650 and operation of the moldboard assembly 662 in forming a level cut is illustrated. In this application, the drag plate 670 is relatively parallel to and flush with the ground surface S. A plate 670 presses against the surface S and provides vertical support for the excavating wheel assembly 660.

The particular advantages of the embodiment of FIG. 27 are also illustrated in FIGS. 28*b* and 28*c*. In these Figures, the grade of the excavation is greatly exaggerated to better illustrate the desired angular relationship of the excavating wheel assembly 660 and moldboard assembly 662.

In FIG. 28*b*, the apparatus is used to dig along a downgrade. The particular geometric relationship of the moldboard causes the plate 670 to be automatically raised relative to the surface S, thus reducing the plate pressure. In FIG. 28*c*, the excavating and loading system 650 is illustrated digging along an upgrade. In this situation, it can be seen that the drag plate 670 is lowered relative to the surface, thus increasing drag. These configurations, illustrated in FIGS. 28*a*, 28*b* and 28*c*, are automatically provided by the geometry of the apparatus.

This operation is the result of the use of a four-bar type linkage wherein the links AB and DE are approximately parallel and where the blade 664 and plate 670 are fixed relative to the link DE.

Thus, it can be seen that a moldboard assembly 662 is provided with a blade which is raised and lowered in an amount proportional to the raising and lowering of the excavating wheel assembly 660. In addition, the drag plate increases the vertical pressure on an upgrade and decreases the pressure on a downgrade.

Figure 29:
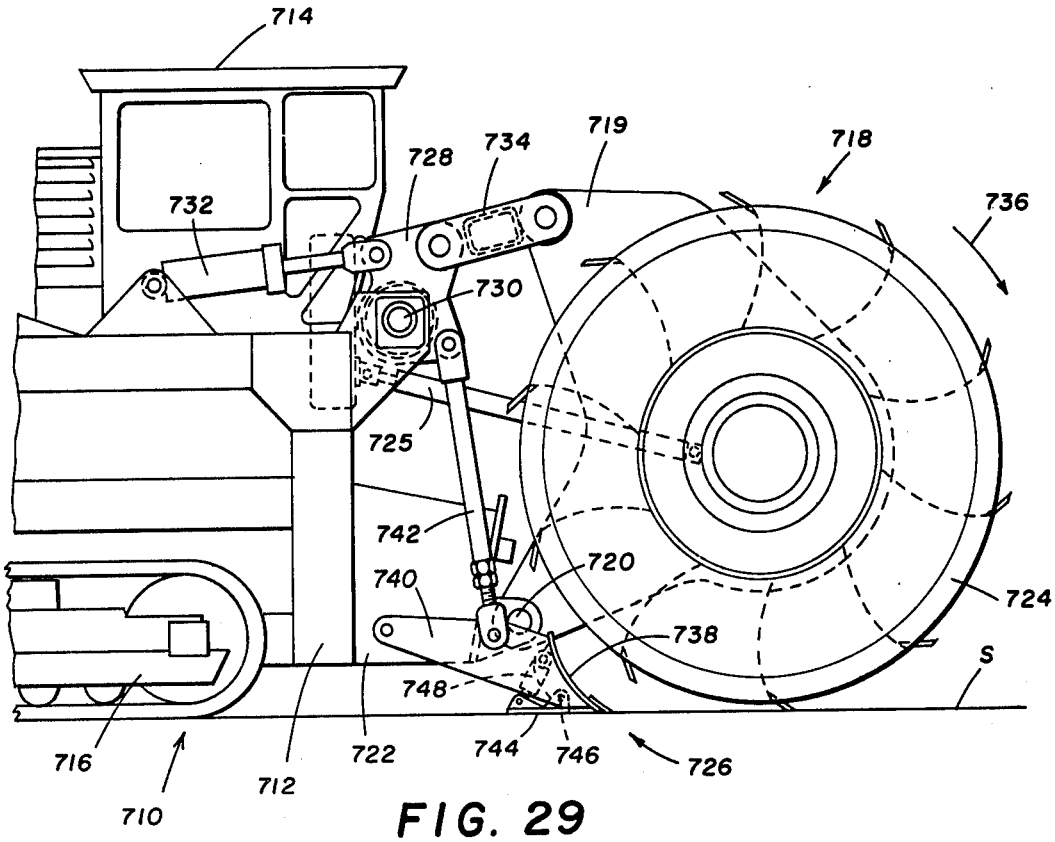
FIG. 29 is a side elevation of a sixth moldboard assembly incorporating the invention.

In FIG. 29, a sixth embodiment of a moldboard assembly incorporating the invention is illustrated. In this Figure, an excavating and loading system 710 is illustrated. Loading system 710 has a main frame 712 with a forward mounted operator cab 714. A track wheel assembly 716 is connected to the frame 712 of the loading system 710 as previously described, in respect to other embodiments.

An excavating wheel assembly 718 is supported on the front of the loading system 710. The assembly 718 has excavating wheels with movable bucket walls as illustrated in FIGS. 7 through 12. An excavating wheel subframe 719 is pivotally attached at 720 to a protruding portion 722 of the frame 712. Excavating wheels 724 are pivotally attached to the frame 719 and are driven by shaft 725.

According to a particular feature of the present invention, the position of the excavating wheel assembly 718 and a moldboard assembly 726 are controlled by a crank arm linkage. The crank arm linkage has a crank arm 728 which is pivotally attached at 730 to the upper portion of the front of main frame 712. A hydraulic cylinder 732 is connected between the main frame 712 and the crank arm 728 to selectively control the rotation of the crank arm 728 about the pivot 730. A connecting link 734 is pivotally connected between the crank arm 728 and frame 719. The excavating wheel assembly 718 will be caused to rotate about pivot 720 in the forward and reverse direction of arrow 736, as the cylinder 732 is operated. This in turn, will raise and lower the excavating wheels 724 with respect to the ground surface "S" to control the digging depths.

A blade 738 is rigidly attached to a pair of arms 740 which are in turn pivotally connected to the portions 722. The blade 738 is positioned under and to the rear of the wheel 724 to pick up and crowd material in a forward direction. A control link 742 is pivotally connected between the arm 740 and arm 728. This link 742 is provided with means for selectively alterating the length thereof and is utilized to set the position of the blade 738 with respect to the wheel 724. In a likewise manner, it can be seen that by rotating the arm 728 by means of the cylinder 732, the arms 740 will be rotated, thus raising and lowering the blade 738. A drag plate 744 is pivotally attached at 746 to the rear of the blade 738. A hydraulic cylinder 748 is connected between blade 738 and plate 744 to selectively control the relative position of the plate 744 and blade 738.

As those of ordinary skill in the art will appreciate, the blade 738 will be raised and lowered proportional to the movement of the excavating wheel 724 while the pressure exerted by the drag plate 744 can be independently adjusted by the hydraulic cylinder 748 as a particular situation dictates.

Figure 31:
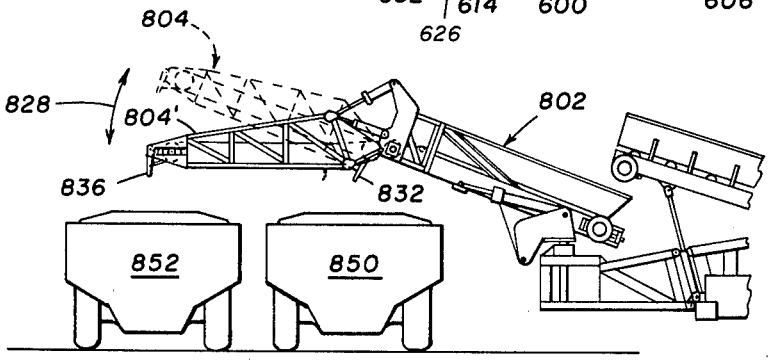
FIG. 31 is a side elevation of the use of the auxiliary conveyor assembly used to selectively load two vehicles.
Figure 30:
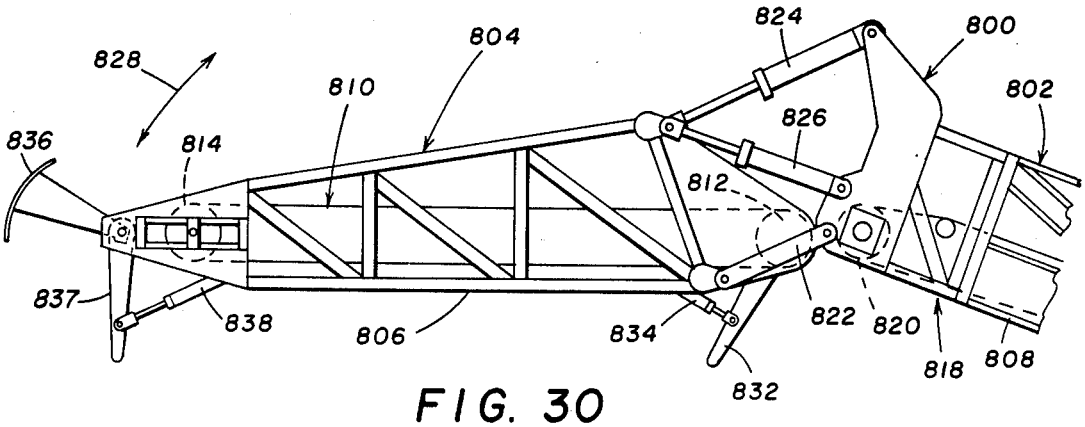
FIG. 30 is an enlarged side elevation of the interconnection of the inner and outer conveyors of the auxiliary conveyor assembly.

In FIGS. 30 and 31, a second embodiment of the connection of the inner and outer conveyors of the auxiliary conveyor assembly is shown. In FIG. 30, the extending end of an auxiliary conveyor assembly 800 is shown. This auxiliary conveyor assembly 800 has an inner conveyor assembly 802 which extends from the excavating and loading system. The auxiliary conveyor system 800 further comprises an outer conveyor assembly 804. The outer conveyor assembly has a frame 806 which is supported from the frame 808 of the inner conveyor assembly 802. An endless belt 810 is supported by the frame 806 for movement around a course defined by a pair of parallel drums 812 and 814. The belt 810 is driven by small hydraulic motors (not shown) mounted in the drums 812 and 814. An endless belt 818 is supported on the frame 808 and is driven by a hydraulic motor (not shown) along the length of the conveyor 802 and around drum 820.

Conveyors 802 and 804 are interconnected by a pair of links 822 which are pivotally connected between the frames 806 and 808. The links 822 are preferably connected to the frames 806 and 808 by means of ball joints for increased reliability, and stabilizing structure is preferably provided to eliminate side swing of the conveyor 804. A first pair of variable length double-acting hydraulic cylinders 824 are connected between the frames 806 and 808 at a position spaced away from and generally parallel to the links 822. A second pair of hydraulic cylinders 826 are connected between the frames 806 and 808.

The hydraulic cylinders 826, when actuated, move the conveyor 804 from a position receiving material from conveyor 802 where the material is transported to and discharged at drum 814. On the other hand, the conveyor 804 can be moved to a position where material is discharged directly from the conveyor 818 at the drum 820.

The hydraulic cylinders 824 are provided to adjust the height of the outer end of the conveyor 804. This is accomplished by varying the lengths of hydraulic cylinders 824 to raise and lower the outer end so that it is adjacent to a truck into which material is discharged. The action of hydraulic cylinders 824 rotates the outer conveyor 804 in the forward and reverse direction of arrows 828, as shown in FIGS. 30 and 31.

A deflection plate 832 is pivotally connected to the outer conveyor 804 adjacent to the drum 812. A pair of hydraulic cylinders 834 are connected between the plate 832 and the frame 806. These cylinders 834 can be actuated to control the position of the plate 832. During discharge into a vehicle over drum 820, the deflection plate 832 can be appropriately positioned to deflect the material into the vehicle as illustrated in FIG. 31. A similar deflection plate 836 is pivotally attached adjacent to the end of the outer conveyor 804. A pair of hydraulic cylinders 838 are connected between arms 837 connected to the plate 836 and the frame 806. The cylinders 838 control the position of the plate 836 which is in turn utilized to deflect material exiting from the conveyor assembly 804 into a dump truck.

The configuration of utilizing the system to load separate dump trucks is utilized in FIG. 31. In this embodiment, dump trucks 850 and 852 are shown in a side-by-side relationship respectively positioned under the ends of the inner and outer conveyors. As can be seen, and as previously described, material can be selectively discharged directly from the end of the inner conveyor 802 and into the waiting vehicle 850. The deflection plate 832 is manipulated to direct the discharge of material from the conveyor. As has also been previously described, the conveyor 804 can receive material from the conveyor 802 and can be rotated down to the horizontal position identified in FIG. 31 as 804'. In this position material is discharged from the end of the conveyor 804' and the deflection plate 836 is utilized to direct the material into the dump truck 852.

In use, the dump truck 850 is first positioned under the end of the inner conveyor 802. The outer conveyor is positioned to allow the material to be discharged from the end of the inner conveyor 802 and into the dump truck 850. While dump truck 850 is being filled, a second dump truck 852 can be placed adjacent to the dump truck 850. Upon completion of the filling of the dump truck 850, the conveyor 804 can be moved to a position where it receives material from conveyor 802 and discharges the material into the dump truck 852. Thereafter, the dump truck 852 can move and other dump truck can be positioned under the inner conveyor 802.

From the foregoing, it will be understood that the present invention comprises additional improvements relating to the excavating and loading system disclosed and claimed in co-pending application Ser. No. 400,043, filed Sept. 24th, 1973, now U.S. Pat. No. 3,897,109.

Thus, in accordance with the invention described herein, an excavating and loading system comprising a vehicle has an excavating wheel assembly supported on one end thereof for excavating the material and transferring the material to a main conveyor. An auxiliary conveyor is mounted behind the main conveyor for pivotal movement generally outwardly and downwardly. This movement raises the material receiving end to the auxiliary conveyor. The upward and rearward portion of the main conveyor is then pivoted downward into the space provided by the outward movement of material receiving end of the auxiliary conveyor. The auxiliary conveyor is then rotated over the discharge end of the main conveyor. This substantially reduces the overall height of the excavating and loading system for travel purposes.

In addition, the outer portion of the auxiliary conveyor is provided with means for allowing the outer portion to be folded back up under the inner portion of the auxiliary conveyor to further reduce the upward and rearward extension of the system for travel purposes.

In accordance with another embodiment of the present invention, an excavating and loading system with an excavating wheel assembly at one end is disclosed. Various moldboard configurations are described supported generally behind and beneath the excavating wheel assembly. The moldboard assembly is pivotally supported, and a linkage connects the moldboard to apparatus which controls the vertical position of the excavating wheel assembly. The moldboard is automatically lowered as the excavating wheel assembly is lowered to initiate an excavation and is raised as the excavating wheel assembly is raised to terminate an excavation. The moldboard itself provides stabilization to partially support the excavating wheel assembly. Various mechanisms are disclosed for varying the support force provided by the moldboard assembly.

In accordance with other embodiments in the present invention, an excavating and loading system is described comprising a vehicle having an excavating wheel at one end thereof and a main conveyor and auxiliary conveyor at the other end. The auxiliary conveyor assembly has two in-line conveyors. The innermost conveyors are arranged to selectively discharge material onto the other conveyor or into a vehicle. The outer conveyor is adjustable in attitude with respect to the inner conveyor to control the discharge height of the outer conveyor. Deflector plates are mounted at the discharge ends of the inner and outer conveyors to direct the discharging material therefrom.

Although particular embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit and scope of the invention as defined in the appended claims.

I claim:

1. An excavating wheel comprising:

a pair of spaced apart side plates mounted for rotation about and each extending radially outwardly with respect to a central axis of rotation;

a plurality of stationary walls each extending between the side plates and each having outwardly projecting material cutting means;

said stationary walls being stationary with respect to the side plates;

a plurality of movable walls each extending between the side plates for cooperation with one of the stationary walls to define a digging bucket;

said plurality of stationary walls and said plurality of movable walls cooperating with the side plates to define a plurality of digging buckets positioned immediately adjacent one another about the entire periphery of the excavating wheel;

each of said movable walls being supported by the side plates for pivotal movement between a material receiving position and a material dumping position;

means entirely enclosed by the digging buckets and the side plates and responsive to rotation of the excavating wheel for positively pivoting the movable wall of each digging bucket to the material receiving position during one portion of said rotation and for positively pivoting the movable wall of each digging bucket to the material dumping position during another portion of said rotation; and said means for positively pivoting the movable wall of each digging bucket comprising:

a spring connected to each movable wall for normally positioning the movable wall in the material receiving position;

a cam mounted on each movable wall; and means fixedly supported at a point offset from the rotational axis of the excavating wheel for engagement with the cams on the movable walls to pivot each movable wall to the material dumping position against the action of the spring associated therewith.

* * * * *